US009926804B2

(12) United States Patent
Nicolas et al.

(10) Patent No.: US 9,926,804 B2
(45) Date of Patent: Mar. 27, 2018

(54) FAN ASSEMBLY

(75) Inventors: Frederic Nicolas, Malmesbury (GB); Alan Howard Davis, Malmesbury (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 814 days.

(21) Appl. No.: 13/882,936

(22) PCT Filed: Oct. 7, 2011

(86) PCT No.: PCT/GB2011/051928

§ 371 (c)(1),
(2), (4) Date: Jul. 11, 2013

(87) PCT Pub. No.: WO2012/059730

PCT Pub. Date: May 10, 2012

(65) Prior Publication Data

US 2013/0280051 A1 Oct. 24, 2013

(30) Foreign Application Priority Data

Nov. 2, 2010 (GB) ..... 1018474.5
Nov. 2, 2010 (GB) ..... 1018475.2
(Continued)

(51) Int. Cl.
*F04D 25/08* (2006.01)
*F04F 5/16* (2006.01)
(Continued)

(52) U.S. Cl.
CPC ..... *F01D 25/00* (2013.01); *F04D 25/08* (2013.01); *F04F 5/16* (2013.01); *F04F 5/46* (2013.01)

(58) Field of Classification Search
CPC ..... F04D 25/08; F04D 29/522; F04D 29/541; F04D 29/545; F04D 29/547; F04F 5/46; F04F 5/16; F01D 25/00
See application file for complete search history.

(56) References Cited

U.S. PATENT DOCUMENTS 284,962 A 9/1883 Huston
1,357,261 A 11/1920 Svoboda
(Continued)

FOREIGN PATENT DOCUMENTS

BE 560119 8/1957
CA 1055344 5/1979
(Continued)

OTHER PUBLICATIONS

Li et al., U.S. Office Action dated Oct. 25, 2013, directed to U.S. Appl. No. 13/686,480; 17 pages.
(Continued)

*Primary Examiner* — Logan Kraft
*Assistant Examiner* — Danielle M Christensen
(74) *Attorney, Agent, or Firm* — Morrison & Foerster LLP

(57) ABSTRACT

A fan assembly includes an annular nozzle and a system for creating a primary air flow. The nozzle includes an outer wall and an inner wall surrounded by the outer wall, the inner wall defining a bore having a bore axis. The nozzle also includes an interior passage located between the inner and outer walls, and extending about the bore axis for receiving an air flow, and an air outlet located at or towards the front of the nozzle for emitting the air flow. The nozzle is configured to emit the air flow through the air outlet in a direction extending away from the bore axis.

19 Claims, 16 Drawing Sheets

(30) Foreign Application Priority Data

Nov. 2, 2010 (GB) ..... 1018476.0
Nov. 2, 2010 (GB) ..... 1018477.8

(51) Int. Cl.
*F01D 25/00* (2006.01)
*F04F 5/46* (2006.01)

(56) References Cited

U.S. PATENT DOCUMENTS 1,767,060 A 6/1930 Ferguson
1,896,869 A 2/1933 Larsh
1,912,596 A * 6/1933 Schmidt ..... F24F 1/0007 165/122
2,014,185 A 9/1935 Martin
2,035,733 A 3/1936 Wall
2,071,266 A 2/1937 Schmidt
D103,476 S 3/1937 Weber
2,115,883 A 5/1938 Sher
D115,344 S 6/1939 Chapman
2,210,458 A 8/1940 Keilholtz
2,258,961 A 10/1941 Saathoff
2,295,502 A 9/1942 Lamb
2,336,295 A 12/1943 Reimuller
2,363,839 A 11/1944 Demuth
2,433,795 A 12/1947 Stokes
2,473,325 A 6/1949 Aufiero
2,476,002 A 7/1949 Stalker
2,488,467 A 11/1949 De Lisio
2,510,132 A 6/1950 Morrison
2,544,379 A 3/1951 Davenport
2,547,448 A 4/1951 Demuth
2,583,374 A 1/1952 Hoffman
2,620,127 A 12/1952 Radcliffe
2,711,682 A 6/1955 Drechsel
2,765,977 A 10/1956 Morrison
2,808,198 A 10/1957 Morrison
2,813,673 A 11/1957 Smith
2,830,779 A 4/1958 Wentling
2,838,229 A 6/1958 Belanger
2,922,277 A 1/1960 Bertin
2,922,570 A 1/1960 Allen
3,004,403 A 10/1961 Laporte
3,047,208 A 7/1962 Coanda
3,270,655 A 9/1966 Guirl et al.
D206,973 S 2/1967 De Lisio
3,503,138 A 3/1970 Fuchs et al.
3,518,776 A 7/1970 Wolff et al.
3,724,092 A 4/1973 McCleerey
3,729,934 A 5/1973 Denning et al.
3,743,186 A 7/1973 Mocarski
3,795,367 A 3/1974 Mocarski
3,872,916 A 3/1975 Beck
3,875,745 A 4/1975 Franklin
3,885,891 A 5/1975 Throndson
3,943,329 A 3/1976 Hlavac
4,037,991 A 7/1977 Taylor
4,046,492 A 9/1977 Inglis
4,061,188 A 12/1977 Beck
4,073,613 A 2/1978 Desty
4,090,814 A 5/1978 Teodorescu et al.
4,113,416 A 9/1978 Kataoka et al.
4,136,735 A 1/1979 Beck et al.
4,173,995 A 11/1979 Beck
4,180,130 A 12/1979 Beck et al.
4,184,417 A 1/1980 Chancellor
4,184,541 A 1/1980 Beck et al.
4,192,461 A 3/1980 Arborg
4,332,529 A 6/1982 Alperin
4,336,017 A 6/1982 Desty
4,342,204 A 8/1982 Melikian et al.
4,448,354 A 5/1984 Reznick et al.
4,568,243 A 2/1986 Schubert et al.
4,630,475 A 12/1986 Mizoguchi
4,643,351 A 2/1987 Fukamachi et al.
4,703,152 A 10/1987 Shih-Chin
4,718,870 A 1/1988 Watts
4,732,539 A 3/1988 Shin-Chin
4,734,017 A 3/1988 Levin
4,790,133 A 12/1988 Stuart
4,850,804 A 7/1989 Huang
4,878,620 A 11/1989 Tarleton
4,893,990 A 1/1990 Tomohiro et al.
4,978,281 A 12/1990 Conger, IV
5,061,405 A 10/1991 Stanek et al.
D325,435 S 4/1992 Coup et al.
5,110,266 A 5/1992 Toyoshima et al.
5,168,722 A 12/1992 Brock
5,176,856 A 1/1993 Takahashi et al.
5,188,508 A 2/1993 Scott et al.
5,296,769 A 3/1994 Havens et al.
5,310,313 A 5/1994 Chen
5,317,815 A 6/1994 Hwang
5,402,938 A 4/1995 Sweeney
5,407,324 A 4/1995 Starnes, Jr. et al.
5,425,902 A 6/1995 Miller et al.
5,435,489 A 7/1995 Jenkins et al.
5,518,370 A 5/1996 Wang et al.
5,609,473 A 3/1997 Litvin
5,645,769 A 7/1997 Tamaru et al.
5,649,370 A 7/1997 Russo
5,671,321 A 9/1997 Bagnuolo
5,735,683 A 4/1998 Muschelknautz
5,761,900 A * 6/1998 Presz, Jr. ..... F02K 1/36 239/265.17
5,762,034 A 6/1998 Foss
5,762,661 A 6/1998 Kleinberger et al.
5,783,117 A 7/1998 Byassee et al.
5,794,306 A 8/1998 Firdaus
D398,983 S 9/1998 Keller et al.
5,841,080 A 11/1998 Iida et al.
5,843,344 A 12/1998 Junket et al.
5,862,037 A 1/1999 Behl
5,868,197 A 2/1999 Potier
5,881,685 A 3/1999 Foss et al.
D415,271 S 10/1999 Feer
6,015,274 A 1/2000 Bias et al.
6,073,881 A 6/2000 Chen
D429,808 S 8/2000 Krauss et al.
6,123,618 A 9/2000 Day
6,155,782 A 12/2000 Hsu
D435,899 S 1/2001 Melwani
6,254,337 B1 7/2001 Arnold
6,269,549 B1 8/2001 Carlucci et al.
6,278,248 B1 8/2001 Hong et al.
6,282,746 B1 9/2001 Schleeter
6,293,121 B1 9/2001 Labrador
6,321,034 B2 11/2001 Jones-Lawlor et al.
6,386,845 B1 5/2002 Bedard
6,480,672 B1 11/2002 Rosenzweig et al.
6,599,088 B2 7/2003 Stagg
6,604,694 B1 8/2003 Kordas et al.
D485,895 S 1/2004 Melwani
6,789,787 B2 9/2004 Stutts
6,791,056 B2 9/2004 VanOtteren et al.
6,830,433 B2 12/2004 Birdsell et al.
7,059,826 B2 6/2006 Lasko
7,088,913 B1 8/2006 Verhoorn et al.
7,147,336 B1 12/2006 Chou
D539,414 S 3/2007 Russak et al.
7,192,258 B2 3/2007 Kuo et al.
7,198,473 B2 4/2007 Stickland et al.
7,412,781 B2 8/2008 Mattinger et al.
7,478,993 B2 1/2009 Hong et al.
7,540,474 B1 6/2009 Huang et al.
D598,532 S 8/2009 Dyson et al.
D602,143 S 10/2009 Gammack et al.
D602,144 S 10/2009 Dyson et al.
D605,748 S 12/2009 Gammack et al.
7,660,110 B2 2/2010 Vinson et al.
7,664,377 B2 2/2010 Liao
D614,280 S 4/2010 Dyson et al.
7,731,050 B2 6/2010 Huang
7,775,848 B1 8/2010 Auerbach

(56) References Cited

U.S. PATENT DOCUMENTS

| | | | |
|---|---|---|---|
| 7,806,388 | B2 | 10/2010 | Junkel et al. |
| 7,841,045 | B2 | 11/2010 | Shaanan et al. |
| 8,002,520 | B2 | 8/2011 | Dawson et al. |
| 8,092,166 | B2 | 1/2012 | Nicolas et al. |
| 8,113,490 | B2 | 2/2012 | Chen |
| 8,152,495 | B2 | 4/2012 | Boggess, Jr. et al. |
| 8,246,317 | B2 | 8/2012 | Gammack |
| 8,308,445 | B2 | 11/2012 | Gammack et al. |
| 8,348,629 | B2 | 1/2013 | Fitton et al. |
| 8,356,804 | B2 | 1/2013 | Fitton et al. |
| 8,454,322 | B2 | 6/2013 | Gammack et al. |
| 8,529,226 | B2 | 9/2013 | Li |
| 8,544,826 | B2 | 10/2013 | Ediger et al. |
| 8,721,307 | B2 | 5/2014 | Li |
| 2002/0106547 | A1 | 8/2002 | Sugawara et al. |
| 2003/0059307 | A1 | 3/2003 | Moreno et al. |
| 2003/0164367 | A1 | 9/2003 | Bucher et al. |
| 2003/0171093 | A1 | 9/2003 | Gumucio Del Pozo |
| 2003/0190183 | A1 | 10/2003 | Hsing |
| 2004/0022631 | A1 | 2/2004 | Birdsell et al. |
| 2004/0049842 | A1 | 3/2004 | Prehodka |
| 2004/0106370 | A1 | 6/2004 | Honda et al. |
| 2004/0149881 | A1 | 8/2004 | Allen |
| 2005/0031448 | A1 | 2/2005 | Lasko et al. |
| 2005/0053465 | A1 | 3/2005 | Roach et al. |
| 2005/0069407 | A1 | 3/2005 | Winkler et al. |
| 2005/0128698 | A1 | 6/2005 | Huang |
| 2005/0163670 | A1 | 7/2005 | Alleyne et al. |
| 2005/0173997 | A1 | 8/2005 | Schmid et al. |
| 2005/0281672 | A1 | 12/2005 | Parker et al. |
| 2006/0172682 | A1 | 8/2006 | Orr et al. |
| 2006/0199515 | A1 | 9/2006 | Lasko et al. |
| 2006/0263073 | A1 | 11/2006 | Clarke et al. |
| 2006/0279927 | A1 | 12/2006 | Strohm |
| 2007/0035189 | A1 | 2/2007 | Matsumoto |
| 2007/0041857 | A1 | 2/2007 | Fleig |
| 2007/0065280 | A1 | 3/2007 | Fok |
| 2007/0166160 | A1 | 7/2007 | Russak et al. |
| 2007/0176502 | A1 | 8/2007 | Kasai et al. |
| 2007/0224044 | A1 | 9/2007 | Hong et al. |
| 2007/0269323 | A1 | 11/2007 | Zhou et al. |
| 2008/0020698 | A1 | 1/2008 | Spaggiari |
| 2008/0124060 | A1 | 5/2008 | Gao |
| 2008/0152482 | A1 | 6/2008 | Patel |
| 2008/0166224 | A1 | 7/2008 | Giffin |
| 2008/0286130 | A1 | 11/2008 | Purvines |
| 2008/0314250 | A1 | 12/2008 | Cowie et al. |
| 2009/0026850 | A1 | 1/2009 | Fu |
| 2009/0032130 | A1 | 2/2009 | Dumas et al. |
| 2009/0039805 | A1 | 2/2009 | Tang |
| 2009/0060710 | A1 | 3/2009 | Gammack et al. |
| 2009/0060711 | A1 | 3/2009 | Gammack et al. |
| 2009/0078120 | A1 | 3/2009 | Kummer et al. |
| 2009/0120925 | A1 | 5/2009 | Lasko |
| 2009/0191054 | A1 | 7/2009 | Winkler |
| 2009/0214341 | A1 | 8/2009 | Craig |
| 2010/0114513 | A1 | 5/2010 | Mallavarapu et al. |
| 2010/0133707 | A1 | 6/2010 | Huang |
| 2010/0150699 | A1 | 6/2010 | Nicolas et al. |
| 2010/0162011 | A1 | 6/2010 | Min |
| 2010/0171465 | A1 | 7/2010 | Seal et al. |
| 2010/0225012 | A1 | 9/2010 | Fitton et al. |
| 2010/0226749 | A1 | 9/2010 | Gammack et al. |
| 2010/0226750 | A1 | 9/2010 | Gammack |
| 2010/0226751 | A1 | 9/2010 | Gammack et al. |
| 2010/0226752 | A1 | 9/2010 | Gammack et al. |
| 2010/0226753 | A1 | 9/2010 | Dyson et al. |
| 2010/0226754 | A1 | 9/2010 | Hutton et al. |
| 2010/0226758 | A1 | 9/2010 | Cookson et al. |
| 2010/0226763 | A1 | 9/2010 | Gammack et al. |
| 2010/0226764 | A1 | 9/2010 | Gammack et al. |
| 2010/0226769 | A1 | 9/2010 | Helps |
| 2010/0226771 | A1 | 9/2010 | Crawford et al. |
| 2010/0226787 | A1 | 9/2010 | Gammack et al. |
| 2010/0226797 | A1 | 9/2010 | Fitton et al. |
| 2010/0226801 | A1 | 9/2010 | Gammack |
| 2010/0254800 | A1 | 10/2010 | Fitton et al. |
| 2011/0000983 | A1* | 1/2011 | Chang ..... B05B 1/18 239/567 |
| 2011/0058935 | A1 | 3/2011 | Gammack et al. |
| 2011/0110805 | A1 | 5/2011 | Gammack et al. |
| 2011/0164959 | A1 | 7/2011 | Fitton et al. |
| 2011/0223014 | A1 | 9/2011 | Crawford et al. |
| 2011/0223015 | A1 | 9/2011 | Gammack et al. |
| 2012/0031509 | A1 | 2/2012 | Wallace et al. |
| 2012/0033952 | A1 | 2/2012 | Wallace et al. |
| 2012/0034108 | A1 | 2/2012 | Wallace et al. |
| 2012/0039705 | A1 | 2/2012 | Gammack |
| 2012/0045315 | A1 | 2/2012 | Gammack |
| 2012/0045316 | A1 | 2/2012 | Gammack |
| 2012/0057959 | A1 | 3/2012 | Hodgson et al. |
| 2012/0082561 | A1 | 4/2012 | Gammack et al. |
| 2012/0093629 | A1 | 4/2012 | Fitton et al. |
| 2012/0093630 | A1 | 4/2012 | Fitton et al. |
| 2012/0230658 | A1 | 9/2012 | Fitton et al. |
| 2012/0308375 | A1 | 12/2012 | Gammack |
| 2013/0026664 | A1 | 1/2013 | Staniforth et al. |
| 2013/0028763 | A1 | 1/2013 | Staniforth et al. |
| 2013/0028766 | A1 | 1/2013 | Staniforth et al. |
| 2013/0129490 | A1 | 5/2013 | Dos Reis et al. |
| 2013/0161842 | A1 | 6/2013 | Fitton et al. |
| 2013/0199372 | A1 | 8/2013 | Nock et al. |
| 2013/0272858 | A1 | 10/2013 | Stickney et al. |
| 2013/0280061 | A1 | 10/2013 | Stickney |
| 2013/0280096 | A1 | 10/2013 | Gammack et al. |
| 2013/0323100 | A1 | 12/2013 | Poulton et al. |
| 2014/0079566 | A1 | 3/2014 | Gammack et al. |
| 2014/0084492 | A1 | 3/2014 | Staniforth et al. |
| 2014/0210114 | A1 | 7/2014 | Staniforth et al. |
| 2014/0255173 | A1 | 9/2014 | Poulton et al. |
| 2014/0255217 | A1 | 9/2014 | Li |

FOREIGN PATENT DOCUMENTS

| | | |
|---|---|---|
| CA | 2155482 | 9/1996 |
| CH | 346643 | 5/1960 |
| CN | 2085866 | 10/1991 |
| CN | 2111392 | 7/1992 |
| CN | 1437300 | 8/2003 |
| CN | 2650005 | 10/2004 |
| CN | 2713643 | 7/2005 |
| CN | 1680727 | 10/2005 |
| CN | 2833197 | 11/2006 |
| CN | 201011346 | 1/2008 |
| CN | 201180678 | 1/2009 |
| CN | 201221477 | 4/2009 |
| CN | 101424279 | 5/2009 |
| CN | 101451754 | 6/2009 |
| CN | 201281416 | 7/2009 |
| CN | 201349269 | 11/2009 |
| CN | 101684828 | 3/2010 |
| CN | 201486901 | 5/2010 |
| CN | 101749288 | 6/2010 |
| CN | 201502549 | 6/2010 |
| CN | 201507461 | 6/2010 |
| CN | 101825096 | 9/2010 |
| CN | 101825101 | 9/2010 |
| CN | 101825102 | 9/2010 |
| CN | 101825103 A | 9/2010 |
| CN | 101825104 | 9/2010 |
| CN | 201568337 | 9/2010 |
| CN | 101858355 | 10/2010 |
| CN | 101936310 | 1/2011 |
| CN | 201696365 U | 1/2011 |
| CN | 201696366 | 1/2011 |
| CN | 201739199 U | 2/2011 |
| CN | 101984299 | 3/2011 |
| CN | 101985948 | 3/2011 |
| CN | 201763705 | 3/2011 |
| CN | 201763706 | 3/2011 |
| CN | 201770513 | 3/2011 |
| CN | 201771875 | 3/2011 |
| CN | 201779080 | 3/2011 |
| CN | 201786777 | 4/2011 |

(56) References Cited

FOREIGN PATENT DOCUMENTS

| | | | | |
|---|---|---|---|---|
| CN | 201786778 | | 4/2011 | |
| CN | 201802648 | | 4/2011 | |
| CN | 102095236 | | 6/2011 | |
| CN | 201858204 | | 6/2011 | |
| CN | 201874898 | | 6/2011 | |
| CN | 201874901 | U | 6/2011 | |
| CN | 201917047 | | 8/2011 | |
| CN | 102251973 | A | 11/2011 | |
| CN | 102287357 | | 12/2011 | |
| CN | 102367813 | | 3/2012 | |
| CN | 202267207 | | 6/2012 | |
| CN | 202431623 | | 9/2012 | |
| DE | 1 291 090 | | 3/1969 | |
| DE | 24 51 557 | | 5/1976 | |
| DE | 27 48 724 | | 5/1978 | |
| DE | 3644567 | | 7/1988 | |
| DE | 19510397 | | 9/1996 | |
| DE | 197 12 228 | | 10/1998 | |
| DE | 100 00 400 | | 3/2001 | |
| DE | 19959596 | A1 * | 6/2001 | ..... F01D 17/105 |
| DE | 10041805 | | 6/2002 | |
| DE | 10 2009 007 037 | | 8/2010 | |
| EP | 0 044 494 | | 1/1982 | |
| EP | 0186581 | | 7/1986 | |
| EP | 0 784 947 | | 7/1997 | |
| EP | 1 094 224 | | 4/2001 | |
| EP | 1 138 954 | | 10/2001 | |
| EP | 1357296 | B1 | 10/2003 | |
| EP | 1 779 745 | | 5/2007 | |
| EP | 1 939 456 | | 7/2008 | |
| EP | 1 980 432 | | 10/2008 | |
| EP | 2 000 675 | | 12/2008 | |
| EP | 2191142 | | 6/2010 | |
| EP | 2 578 889 | | 4/2013 | |
| FR | 1033034 | | 7/1953 | |
| FR | 1119439 | | 6/1956 | |
| FR | 1.387.334 | | 1/1965 | |
| FR | 2 375 471 | | 7/1978 | |
| FR | 2 534 983 | | 4/1984 | |
| FR | 2 640 857 | | 6/1990 | |
| FR | 2 658 593 | | 8/1991 | |
| FR | 2794195 | | 12/2000 | |
| FR | 2 874 409 | | 2/2006 | |
| FR | 2 906 980 | | 4/2008 | |
| FR | 2928706 | | 9/2009 | |
| GB | 22235 | | 6/1914 | |
| GB | 383498 | | 11/1932 | |
| GB | 593828 | | 10/1947 | |
| GB | 601222 | | 4/1948 | |
| GB | 633273 | | 12/1949 | |
| GB | 641622 | | 8/1950 | |
| GB | 661747 | | 11/1951 | |
| GB | 863 124 | | 3/1961 | |
| GB | 1067956 | | 5/1967 | |
| GB | 1262131 | | 2/1972 | |
| GB | 1265341 | | 3/1972 | |
| GB | 1 278 606 | | 6/1972 | |
| GB | 1 304 560 | | 1/1973 | |
| GB | 1 403 188 | | 8/1975 | |
| GB | 1 434 226 | | 5/1976 | |
| GB | 1501473 | | 2/1978 | |
| GB | 2 094 400 | | 9/1982 | |
| GB | 2 107 787 | | 5/1983 | |
| GB | 2 111 125 | | 6/1983 | |
| GB | 2 178 256 | | 2/1987 | |
| GB | 2 185 533 | | 7/1987 | |
| GB | 2185531 | | 7/1987 | |
| GB | 2 218 196 | | 11/1989 | |
| GB | 2236804 | | 4/1991 | |
| GB | 2 240 268 | | 7/1991 | |
| GB | 2242935 | | 10/1991 | |
| GB | 2 285 504 | | 7/1995 | |
| GB | 2 289 087 | | 11/1995 | |
| GB | 2383277 | | 6/2003 | |
| GB | 2 428 569 | | 2/2007 | |
| GB | 2 452 593 | | 3/2009 | |
| GB | 2452490 | | 3/2009 | |
| GB | 2463698 | | 3/2010 | |
| GB | 2464736 | | 4/2010 | |
| GB | 2466058 | | 6/2010 | |
| GB | 2468312 | | 9/2010 | |
| GB | 2468313 | | 9/2010 | |
| GB | 2468315 | | 9/2010 | |
| GB | 2468317 | A | 9/2010 | |
| GB | 2468319 | | 9/2010 | |
| GB | 2468320 | | 9/2010 | |
| GB | 2468323 | | 9/2010 | |
| GB | 2468328 | | 9/2010 | |
| GB | 2468331 | | 9/2010 | |
| GB | 2468369 | | 9/2010 | |
| GB | 2468498 | | 9/2010 | |
| GB | 2473037 | | 3/2011 | |
| GB | 2479760 | | 10/2011 | |
| GB | 2482547 | | 2/2012 | |
| GB | 2484671 | | 4/2012 | |
| GB | 2484695 | A | 4/2012 | |
| GB | 2484761 | | 4/2012 | |
| GB | 2493231 | A | 1/2013 | |
| GB | 2493505 | A | 2/2013 | |
| GB | 2493507 | A | 2/2013 | |
| GB | 2500011 | | 9/2013 | |
| JP | 31-13055 | | 8/1956 | |
| JP | 35-4369 | | 3/1960 | |
| JP | 39-7297 | | 3/1964 | |
| JP | 46-7230 | | 12/1971 | |
| JP | 49-150403 | | 12/1974 | |
| JP | 51-7258 | | 1/1976 | |
| JP | 53-60100 | | 5/1978 | |
| JP | 56-167897 | | 12/1981 | |
| JP | 57-71000 | | 5/1982 | |
| JP | 57-157097 | | 9/1982 | |
| JP | 61-31830 | | 2/1986 | |
| JP | 61-116093 | | 6/1986 | |
| JP | 61-280787 | | 12/1986 | |
| JP | 62-223494 | | 10/1987 | |
| JP | 63-36794 | | 3/1988 | |
| JP | 63-179198 | | 7/1988 | |
| JP | 63-306340 | | 12/1988 | |
| JP | 64-21300 | U | 2/1989 | |
| JP | 64-58955 | | 3/1989 | |
| JP | 64-83884 | | 3/1989 | |
| JP | 1-138399 | | 5/1989 | |
| JP | 1-224598 | | 9/1989 | |
| JP | 2-146294 | | 6/1990 | |
| JP | 2-218890 | | 8/1990 | |
| JP | 2-248690 | | 10/1990 | |
| JP | 3-52515 | | 5/1991 | |
| JP | 3-267598 | | 11/1991 | |
| JP | 3-286775 | | 12/1991 | |
| JP | 4-43895 | | 2/1992 | |
| JP | 4-366330 | | 12/1992 | |
| JP | 5-157093 | | 6/1993 | |
| JP | 5-164089 | | 6/1993 | |
| JP | 5-263786 | | 10/1993 | |
| JP | 6-74190 | | 3/1994 | |
| JP | 6-86898 | | 3/1994 | |
| JP | 6-147188 | | 5/1994 | |
| JP | 6-257591 | | 9/1994 | |
| JP | 6-280800 | | 10/1994 | |
| JP | 6-336113 | | 12/1994 | |
| JP | 7-190443 | | 7/1995 | |
| JP | 8-21400 | | 1/1996 | |
| JP | 8-72525 | | 3/1996 | |
| JP | 9-100800 | | 4/1997 | |
| JP | 9-178083 | | 7/1997 | |
| JP | 9-287600 | | 11/1997 | |
| JP | 11-502586 | | 3/1999 | |
| JP | 11-227866 | | 8/1999 | |
| JP | 2000-116179 | | 4/2000 | |
| JP | 2000-201723 | | 7/2000 | |
| JP | 2001-17358 | | 1/2001 | |
| JP | 2002-21797 | | 1/2002 | |
| JP | 2002-138829 | | 5/2002 | |
| JP | 2002-213388 | | 7/2002 | |

(56) References Cited

FOREIGN PATENT DOCUMENTS

| | | | |
|---|---|---|---|
| JP | 2003-329273 | | 11/2003 |
| JP | 2004-8275 | | 1/2004 |
| JP | 2004-208935 | | 7/2004 |
| JP | 2004-216221 | | 8/2004 |
| JP | 2005-201507 | | 7/2005 |
| JP | 2005-307985 | | 11/2005 |
| JP | 2006-89096 | | 4/2006 |
| JP | 3127331 | | 11/2006 |
| JP | 2007-138763 | | 6/2007 |
| JP | 2007-138789 | | 6/2007 |
| JP | 2008-39316 | | 2/2008 |
| JP | 2008-100204 | | 5/2008 |
| JP | 3146538 | | 10/2008 |
| JP | 2008-294243 | | 12/2008 |
| JP | 2009-44568 | | 2/2009 |
| JP | 2009-62986 | | 3/2009 |
| JP | 2010-131259 | | 6/2010 |
| JP | 2010-203764 | | 9/2010 |
| JP | 2012-31806 | | 2/2012 |
| KR | 1999-002660 | | 1/1999 |
| KR | 10-2005-0102317 | | 10/2005 |
| KR | 2007-0007997 | | 1/2007 |
| KR | 20-0448319 | | 3/2010 |
| KR | 10-2010-0055611 | | 5/2010 |
| KR | 10-0985378 | | 9/2010 |
| TW | 517825 | | 1/2003 |
| TW | 589932 | | 6/2004 |
| TW | M394383 | | 12/2010 |
| TW | M39207 | | 3/2011 |
| TW | M407299 | | 7/2011 |
| WO | WO 90/13478 | | 11/1990 |
| WO | WO-95/06822 | | 3/1995 |
| WO | WO-02/073096 | | 9/2002 |
| WO | WO 03/058795 | | 7/2003 |
| WO | WO-03/069931 | | 8/2003 |
| WO | WO-2005/050026 | | 6/2005 |
| WO | WO 2005/057091 | | 6/2005 |
| WO | WO-2006/008021 | | 1/2006 |
| WO | WO-2006/012526 | | 2/2006 |
| WO | WO 2007/024955 | | 3/2007 |
| WO | WO 2007/048205 | | 5/2007 |
| WO | WO 2008/014641 | | 2/2008 |
| WO | WO-2008/024569 | | 2/2008 |
| WO | WO-2008/139491 | | 11/2008 |
| WO | WO-2009/030879 | | 3/2009 |
| WO | WO-2009/030881 | | 3/2009 |
| WO | WO-2010/100449 | A1 | 9/2010 |
| WO | WO-2010/100451 | | 9/2010 |
| WO | WO-2010/100452 | | 9/2010 |
| WO | WO-2010/100453 | | 9/2010 |
| WO | WO-2010/100462 | | 9/2010 |
| WO | WO-2011/050041 | | 4/2011 |
| WO | WO-2012/006882 | A1 | 1/2012 |
| WO | WO-2012/033517 | A1 | 3/2012 |
| WO | WO-2012/052737 | | 4/2012 |
| WO | WO-2013/014419 | A2 | 1/2013 |

OTHER PUBLICATIONS

Gammack et al., U.S. Office Action dated Apr. 24, 2014, directed to U.S Appl. No. 12/716,740; 16 pages.
Gammack et al., Office Action dated Jun. 12, 2013, directed towards U.S. Appl. No. 12/945,558; 20 pages.
Gammack et al., Office Action dated May 29, 2013, directed towards U.S. Appl. No. 13/588,666; 11 pages.
Wallace et al., Office Action dated Jun. 7, 2013, directed towards U.S. Appl. No. 13/192,223; 30 pages.
Gammack, P. et al., U.S. Office Action dated Feb. 10, 2014, directed to U.S. Appl. No. 12/716,515; 21 pages.
Gammack, P. et al., Office Action dated Aug. 19, 2013, directed to U.S. Appl. No. 12/716,515; 20 pages.
Gammack et al., U.S. Office Action dated Sep. 6, 2013, directed to U.S. Appl. No. 12/716,740; 15 pages.
Gammack et al., Office Action dated Sep. 27, 2013, directed to U.S. Appl. No. 13/588,666; 10 pages.
Wallace et al., Office Action dated Oct. 23, 2013, directed to U.S. Appl. No. 13/192,223; 18 pages.
Fitton et al., U.S. Office Action dated Dec. 31, 2013, directed to U.S. Appl. No. 13/718,693; 8 pages.
Gammack et al., U.S. Office Action dated Sep. 3, 2014, directed to U.S. Appl. No. 13/861,891; 7 pages.
Staniforth et al., U.S. Office Action dated Sep. 18, 2014, directed to U.S. Appl. No. 13/559,142; 18 pages.
Fitton et al., U.S. Office Action dated Jun. 13, 2014, directed to U.S. Appl. No. 13/274,998; 11 pages.
Fitton et al., U.S. Office Action dated Jun. 13, 2014, directed to U.S. Appl. No. 13/275,034; 10 pages.
Search Report and Written Opinion dated Feb. 20, 2012, directed to International Application No. PCT/GB2011/051928;12 pages.
Gammack, P. et al., U.S. Office Action dated Dec. 9, 2010, directed to U.S. Appl. No. 12/203,698; 10 pages.
Gammack, P. et al., U.S. Office Action dated Jun. 21, 2011, directed to U.S. Appl. No. 12/203,698; 11 pages.
Gammack et al., Office Action dated Sep. 17, 2012, directed to U.S. Appl. No. 13/114,707; 12 pages.
Gammack, P. et al., U.S. Office Action dated Dec. 10, 2010, directed to U.S. Appl. No. 12/230,613; 12 pages.
Gammack, P. et al., U.S. Office Action dated May 13, 2011, directed to U.S. Appl. No. 12/230,613; 13 pages.
Gammack, P. et al., U.S. Office Action dated Sep. 7, 2011, directed to U.S. Appl. No. 12/230,613; 15 pages.
Gammack, P. et al., U.S. Office Action dated Jun. 8, 2012, directed to U.S. Appl. No. 12/230,613; 15 pages.
Gammack et al., U.S. Office Action dated Aug. 20, 2012, directed to U.S. Appl. No. 12/945,558; 15 pages.
Gammack et al., U.S. Office Action dated Feb. 28, 2013, directed to U.S. Appl. No. 12/945,558; 16 pages.
Fitton et al., U.S. Office Action dated Nov. 30, 2010 directed to U.S. Appl. No. 12/560,232; 9 pages.
Nicolas, F. et al., U.S. Office Action dated Mar. 7, 2011, directed to U.S. Appl. No. 12/622,844; 10 pages.
Nicolas, F. et al., U.S. Office Action dated Sep. 8, 2011, directed to U.S. Appl. No. 12/622,844; 11 pages.
Helps, D. F. et al., U.S. Office Action dated Feb. 15, 2013, directed to U.S. Appl. No. 12/716,694; 12 pages.
Fitton, et al., U.S. Office Action dated Mar. 8, 2011, directed to U.S. Appl. No. 12/716,780; 12 pages.
Fitton, et al., U.S. Office Action dated Sep. 6, 2011, directed to U.S. Appl. No. 12/716,780; 16 pages.
Gammack, P. et al., U.S. Office Action dated Feb. 14, 2013, directed to U.S. Appl. No. 12/716,515; 21 pages.
Gammack, P. et al., U.S. Office Action dated Dec. 9, 2010, directed to U.S. Appl. No. 12/716,781; 17 pages.
Gammack, P. et al., U.S. Final Office Action dated Jun. 24, 2011, directed to U.S. Appl. No. 12/716,781; 19 pages.
Gammack et al., U.S. Office Action dated Mar. 14, 2013, directed to U.S. Appl. No. 12/716,740; 15 pages.
Gammack, P. et al., U.S. Office Action dated Apr. 12, 2011, directed to U.S. Appl. No. 12/716,749; 8 pages.
Gammack, P. et al., U.S. Office Action dated Sep. 1, 2011, directed to U.S. Appl. No. 12/716,749; 9 pages.
Gammack, P. et al., U.S. Office Action dated Jun. 25, 2012, directed to U.S. Appl. No. 12/716,749; 11 pages.
Fitton et al., U.S. Office Action dated Mar. 30, 2012, directed to U.S. Appl. No. 12/716,707; 7 pages.
Gammack, P. et al., U.S. Office Action dated May 24, 2011, directed to U.S. Appl. No. 12/716,613; 9 pages.
Gammack, P. et al. U.S. Office Action dated Oct. 18, 2012, directed to U.S. Appl. No. 12/917,247; 11 pages.
Reba, I. (1966). "Applications of the Coanda Effect," *Scientific American* 214:84-92.
Third Party Submission Under 37 CFR 1.99 filed Jun. 2, 2011, directed towards U.S. Appl. No. 12/203,698; 3 pages.

* cited by examiner

FAN ASSEMBLY

REFERENCE TO RELATED APPLICATIONS

This application is a national stage application under 35 USC 371 of International Application No. PCT/GB2011/051928, filed Oct. 7, 2011, which claims the priority of United Kingdom Application No. 1018474.5, filed Nov. 2, 2010, United Kingdom Application No. 1018475.2, filed Nov. 2, 2010, United Kingdom Application, No. 1018476.0, filed Nov. 2, 2010, and United Kingdom Application No. 1018477.8, filed Nov. 2, 2010, the entire contents of which are incorporated herein by reference.

FIELD OF THE INVENTION

The present invention relates to a fan assembly. Particularly, but not exclusively, the present invention relates to a floor or table-top fan assembly, such as a desk, tower or pedestal fan.

BACKGROUND OF THE INVENTION

A conventional domestic fan typically includes a set of blades or vanes mounted for rotation about an axis, and drive apparatus for rotating the set of blades to generate an air flow. The movement and circulation of the air flow creates a 'wind chill' or breeze and, as a result, the user experiences a cooling effect as heat is dissipated through convection and evaporation. The blades are generally located within a cage which allows an air flow to pass through the housing while preventing users from coming into contact with the rotating blades during use of the fan.

U.S. Pat. No. 2,488,467 describes a fan which does not use caged blades to project air from the fan assembly. Instead, the fan assembly comprises a base which houses a motor-driven impeller for drawing an air flow into the base, and a series of concentric, annular nozzles connected to the base and each comprising an annular outlet located at the front of the nozzle for emitting the air flow from the fan. Each nozzle extends about a bore axis to define a bore about which the nozzle extends.

Each nozzle is in the shape of an airfoil. An airfoil may be considered to have a leading edge located at the rear of the nozzle, a trailing edge located at the front of the nozzle, and a chord line extending between the leading and trailing edges. In U.S. Pat. No. 2,488,467 the chord line of each nozzle is parallel to the bore axis of the nozzles. The air outlet is located on the chord line, and is arranged to emit the air flow in a direction extending away from the nozzle and along the chord line.

SUMMARY OF THE INVENTION

In a first aspect, the present invention provides an annular nozzle for a fan assembly, the nozzle comprising an inner wall defining a bore having a bore axis, the inner wall having a cross-sectional profile in a plane containing the bore axis which is in the shape of part of a surface of an airfoil having a leading edge, a trailing edge towards the front of the nozzle and a chord line extending between the leading edge and the trailing edge, at least part of the chord line being inclined to the bore axis, an interior passage extending about the bore axis for receiving an air flow, and an air outlet located at or towards the front of the nozzle for emitting the air flow.

The air flow emitted from the annular nozzle, hereafter referred to as a primary air flow, entrains air surrounding the nozzle, which thus acts as an air amplifier to supply both the primary air flow and the entrained air to the user. The entrained air will be referred to here as a secondary air flow. The secondary air flow is drawn from the room space, region or external environment surrounding the nozzle. The primary air flow combines with the entrained secondary air flow to form a combined, or total, air flow projected forward from the front of the nozzle.

Preferably, the airfoil has the shape of a National Advisory Committee for Aeronautics (NACA) airfoil. This airfoil preferably has the shape of a symmetrical 4-digit NACA airfoil, in which case the chord line may be straight and the chord line is inclined to the bore axis. However, the airfoil may have the shape of a cambered 4-digit NACA airfoil, a 5-digit NACA airfoil, a 6-digit NACA airfoil or other asymmetrical airfoil, in which case the chord line may be curved and only part of the chord line is inclined to the bore axis. The outer and inner walls may together have the shape of an airfoil, but the outer wall may take any desired shape. The nozzle is preferably configured so that the primary air flow is emitted away from the inner wall of the nozzle.

By inclining at least part, and more preferably at least the front part, of the chord line to the bore axis, the direction in which the primary air flow is emitted from the air outlet can be adjusted. For example, by inclining at least part of the chord line towards the bore axis in a direction extending from the leading edge to the trailing edge, the primary air flow can be emitted towards the bore axis in the shape of an inwardly tapering cone. On the other hand, by inclining at least part of the chord line away from the bore axis in a direction extending from the leading edge to the trailing edge, the primary air flow can be emitted away from the bore axis in the shape of an outwardly tapering cone.

We have found that this variation of the direction in which the primary air flow is emitted from the nozzle can vary the degree of the entrainment of the secondary air flow by the primary air flow, and thus vary the flow rate of the combined air flow generated by the fan assembly. References herein to absolute or relative values of the flow rate, or the maximum velocity, of the combined air flow are made in respect of those values as recorded at a distance of three times the diameter of the air outlet of the nozzle.

Without wishing to be bound by any theory, we consider that the rate of entrainment of the secondary air flow by the primary air flow may be related to the magnitude of the surface area of the outer profile of the primary air flow emitted from the nozzle. When the primary air flow is outwardly tapering, or flared, the surface area of the outer profile is relatively high, promoting mixing of the primary air flow and the air surrounding the nozzle and thus increasing the flow rate of the combined air flow, whereas when the primary air flow is inwardly tapering, the surface area of the outer profile is relatively low, decreasing the entrainment of the secondary air flow by the primary air flow and so decreasing the flow rate of the combined air flow.

Increasing the flow rate of the combined air flow generated by the nozzle has the effect of decreasing the maximum velocity of the combined air flow. This can make the nozzle suitable for use with a fan assembly for generating a flow of air through a room or an office. On the other hand, decreasing the flow rate of the combined air flow generated by the nozzle has the effect of increasing the maximum velocity of the combined air flow. This can make the nozzle suitable for use with a desk fan or other table-top fan for generating a flow of air for cooling rapidly a user located in front of the fan.

The angle of inclination of said at least part of the chord line to the bore axis can take any desired value, but a preferred angle of inclination is in the range from 0 to 45°.

Preferably, the interior passage extends about the bore axis, and is preferably annular in shape. The interior passage is preferably located between, and more preferably bounded by, the inner wall and an outer wall of the nozzle.

The air outlet preferably extends about the bore axis. The air outlet may be generally annular in shape. For example, the air outlet may be generally circular in shape, but the air outlet may take any desired shape. Alternatively, the air outlet may comprise a plurality of sections which are spaced about the bore axis and each for receiving a respective part of the air flow from the interior passage. The sections may be straight, arcuate, angled or have any other shape.

A portion of the interior passage which is located adjacent the air outlet may be shaped to direct the air flow through the air outlet. This portion of the interior passage may be shaped so that the primary air flow is emitted from the air outlet in a direction which extends along the chord line of the airfoil. Alternatively, this portion of the interior passage may be shaped so that the primary air flow is emitted from the air outlet in a direction which is inclined to at least part of the chord line. This can be provided as an alternative to the inclination of the chord line to the bore axis. For example, inclining the chord line away from the bore axis in a direction extending from the leading edge to the trailing edge may undesirably increase the size of the nozzle. By emitting the primary air flow from the air outlet in a direction which is inclined to the chord line while arranging the chord line so that it is either parallel to the bore axis or inclined towards the bore axis in a direction extending from the leading edge to the trailing edge, an increase in the flow rate of the combined air flow can be achieved without unduly increasing the size of the nozzle.

Therefore, in a second aspect the present invention provides an annular nozzle for a fan assembly, the nozzle comprising an outer wall and an inner wall surrounded by the outer wall, the inner wall defining a bore having a bore axis, the inner wall having a cross-sectional profile in a plane containing the bore axis which is in the shape of part of a surface of an airfoil having a leading edge, a trailing edge and a chord line extending between the leading edge and the trailing edge, an interior passage located between the inner and outer walls, and extending about the bore axis for receiving an air flow, and an air outlet located at or towards the trailing edge for emitting the air flow, and wherein the nozzle is configured to emit the air flow in a direction which is inclined to at least part of the chord line. An angle subtended between said at least part of the chord line and the direction in which the air flow is emitted from the air outlet may take any desired value, but is preferably in the range from 0 to 45°. As mentioned above, the chord line may be curved and so the angle subtended between the chord line and the direction in which the air flow is emitted from the air outlet may vary along the chord line. Depending on the shape of the chord line, only part of the chord line may be inclined to the direction in which the air flow is emitted from the air outlet, or substantially all of the chord line may be inclined to the direction in which the air flow is emitted from the air outlet.

As mentioned above, the chord line may be inclined towards or away from the bore axis in a direction extending from the leading edge to the trailing edge. In an embodiment in which the nozzle is suitable for use as part of a desk fan, at least part of the chord line is inclined to the bore axis so that a majority of the inner wall tapers towards the bore axis.

The shape of the airfoil followed by the inner wall of the nozzle is preferably such that the inner wall comprises a front section adjacent the trailing edge and a rear section adjacent the leading edge. An angle of inclination of the front section of the inner wall to the bore axis is preferably in the range from 0 to 45°. Depending on the shape of the nozzle, the angle of inclination of the front section of the inner wall to the bore axis may be relatively shallow; in one embodiment this angle of inclination is between 0 to 5°. The front section of the inner wall preferably has a shape which is substantially conical.

The shape of the airfoil followed by the inner wall of the nozzle is preferably such that the front section extends from the rear section to the air outlet in a direction extending away from the bore axis.

As mentioned above, to increase the flow rate of the combined air flow generated by the nozzle the primary air flow can be emitted away from the bore axis in the shape of an outwardly tapering cone. Therefore, in a third aspect the present invention provides an annular nozzle for a fan assembly, the nozzle comprising an outer wall and an inner wall surrounded by the outer wall, the inner wall defining a bore having a bore axis, an interior passage located between the inner and outer walls, and extending about the bore axis for receiving an air flow, and an air outlet located at or towards the front of the nozzle, and wherein the nozzle is configured to emit the air flow in a direction which extends away from the bore axis.

The angle subtended between the bore axis and the direction in which the air flow is emitted from the air outlet may take any desired value, but is preferably in the range from 0 to 45°. The angle subtended between the bore axis and the direction in which the air flow is emitted from the air outlet may be substantially constant about the bore axis. Alternatively, the angle subtended between the bore axis and the direction in which the air flow is emitted from the air outlet may vary about the axis. Through varying the angle subtended between the bore axis and the direction in which the air flow is emitted from the air outlet about the axis, the air current generated by the nozzle may have a non-cylindrical or a non-frusto-conical profile without a significant change to the size or shape of the outer surface of the nozzle. For example, the angle may vary about the bore axis between at least one maximum value and at least one minimum value. The angle may vary about the bore axis between a plurality of maximum values and a plurality of minimum values. The maximum values and the minimum values may be regularly or irregularly spaced about the bore axis.

The angle may be at a minimum value at or towards at least one of an upper extremity and a lower extremity of the nozzle. Locating the minimum value at one or both of these extremities can "flatten" the upper and lower extremities of the profile of the air current generated by the nozzle so that the air flow has an oval, rather than circular, profile. The profile of the air current is preferably also widened by locating a maximum value at or towards each side extremity of the nozzle. This flattening, or widening, of the profile of the air current can make the nozzle particularly suitable for use as part of a desk fan in a room, office or other environment to deliver a cooling air current simultaneously to a number of users in proximity to the fan assembly. The angle may vary continuously about the bore axis.

As mentioned above, a portion of the interior passage which is located adjacent the air outlet may be shaped to convey the air flow to the air outlet so that the primary air flow is emitted from the air outlet in an aforementioned direction. To facilitate manufacturing, the interior passage may comprise an air channel for directing the primary air flow through the air outlet. Where the air flow is to be emitted in a direction which is parallel to the bore axis, the air channel may be substantially tubular or cylindrical, and may be centred on the bore axis. Alternatively, where the air flow is to be emitted in a direction which is inclined to the bore axis, the air channel may have a shape which is convergent or divergent. In other words, the air channel has a cross-sectional area in a plane orthogonal to the bore axis, and this cross-sectional area may vary along the bore axis. For example, this cross-sectional area may increase towards the air outlet. The air channel may extend towards the air outlet in a direction extending away from, or towards, the bore axis.

The air outlet may be located at or towards the trailing edge of the airfoil. The air outlet may be located on the chord line of the airfoil. Alternatively, the air outlet may be spaced from the chord line of the airfoil. This can allow the direction at which the air flow is emitted from the nozzle to be inclined further away from the bore axis. In a fifth aspect, the present invention provides an annular nozzle for a fan assembly, the nozzle comprising an inner wall defining a bore having a bore axis, the inner wall having a cross-sectional profile in a plane containing the bore axis which is in the shape of part of a surface of an airfoil having a leading edge, a trailing edge towards the front of the nozzle and a chord line extending between the leading edge and the trailing edge, an interior passage extending about the bore axis for receiving an air flow, and an air outlet located at or towards the trailing edge and spaced from the chord line for emitting the air flow away from the inner wall of the nozzle. The chord line is preferably located between the air outlet and the bore axis, but the air outlet may be located between the chord line and the bore axis.

In a sixth aspect the present invention provides an annular nozzle for a fan assembly, the nozzle comprising an outer wall and an inner wall surrounded by the outer wall, the inner wall defining a bore having a bore axis, the inner wall having a cross-sectional profile in a plane containing the bore axis which is in the shape of part of a surface of an airfoil having a leading edge and a trailing edge towards the front of the nozzle, an interior passage located between the inner and outer walls, and extending about the bore axis for receiving an air flow, and an air outlet located at or towards the trailing edge for emitting the air flow in a direction inclined to the bore axis.

In a seventh aspect the present invention provides a fan assembly comprising means for creating an air flow and a nozzle as described above for emitting the air flow.

The means for creating an air flow preferably comprises an impeller driven by a motor. The motor is preferably a variable speed motor, more preferably a DC motor, having a speed which can be selected by the user between minimum and maximum values. This can allow the user to vary the flow rate of the combined air flow generated by the fan assembly as desired, and so in an eighth aspect the present invention provides a fan assembly comprising an impeller driven by a variable speed motor for generating an air flow, and a nozzle for emitting the air flow, the nozzle comprising an inner wall defining a bore having a bore axis, the inner wall having a cross-sectional profile in a plane containing the bore axis which is in the shape of part of a surface of an airfoil having a leading edge, a trailing edge and a chord line extending between the leading edge and the trailing edge, an interior passage extending about the bore axis for receiving the air flow, and an air outlet located at or towards the trailing edge for emitting the air flow.

Features described above in connection with the first aspect of the invention are equally applicable to any of the second to eighth aspects of the invention, and vice versa.

BRIEF DESCRIPTION OF THE DRAWINGS

Preferred features of the invention will now be described, by way of example only, with reference to the accompanying drawings, in which.

DETAILED DESCRIPTION OF THE INVENTION

Figure 1:
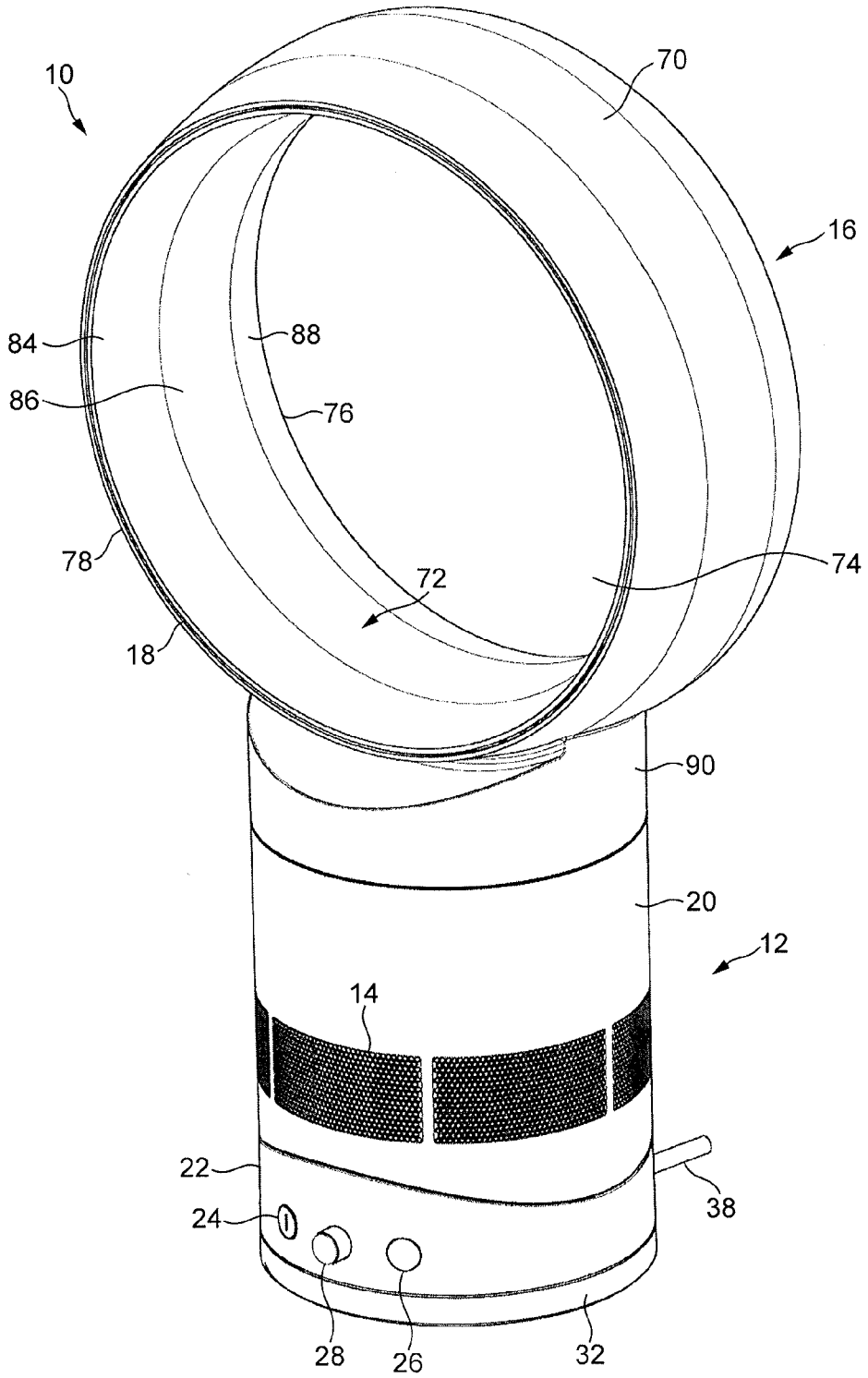
FIG. 1 is a front perspective view of a first embodiment of a fan assembly.
Figure 2:
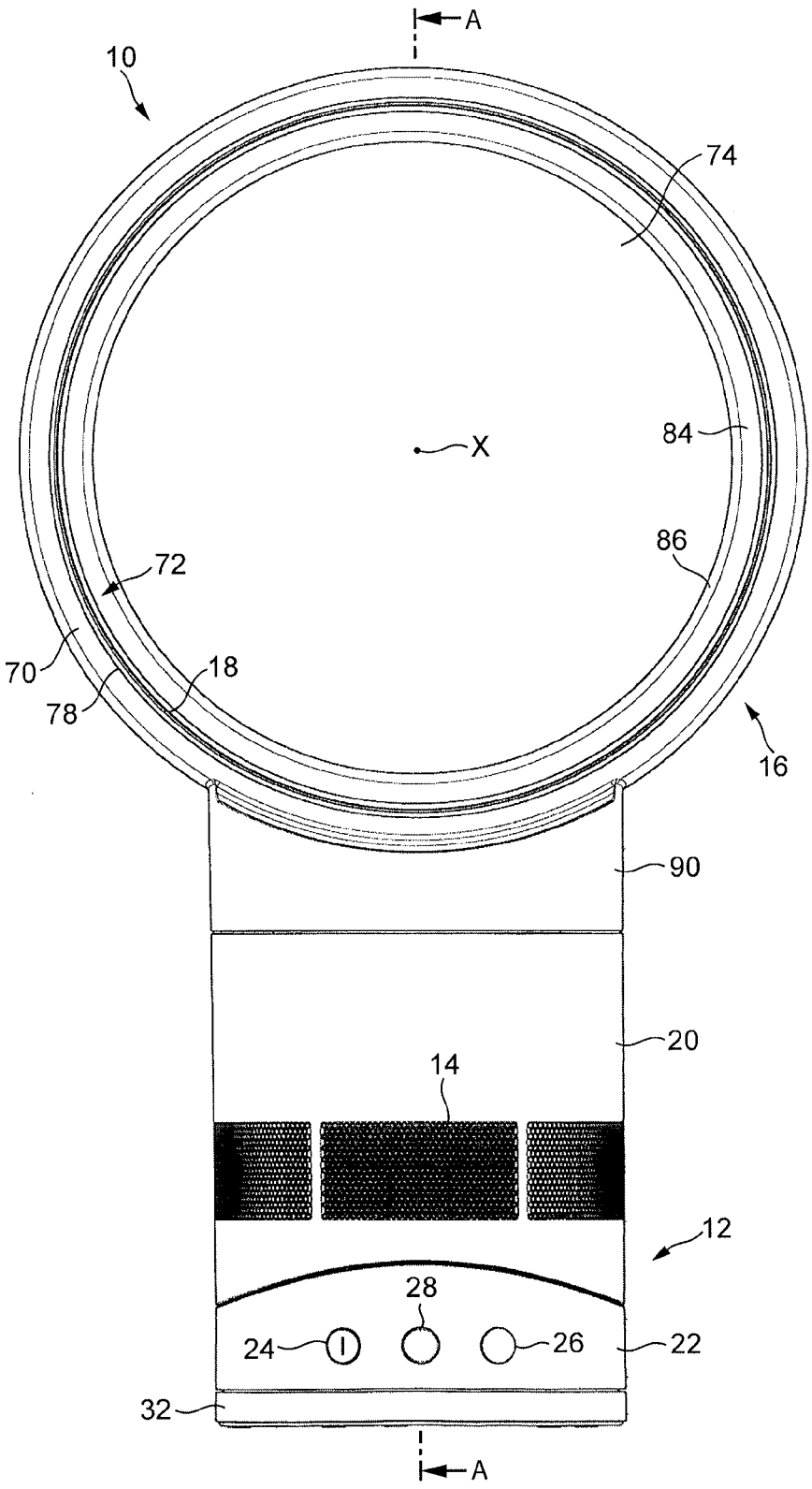
FIG. 2 is a front view of the fan assembly of FIG. 1.

FIGS. 1 and 2 are external views of a first embodiment of a fan assembly 10. The fan assembly 10 comprises a body 12 comprising an air inlet 14 through which a primary air flow enters the fan assembly 10, and an annular nozzle 16 mounted on the body 12, the nozzle 16 comprising an air outlet 18 for emitting the primary air flow from the fan assembly 10.

The body 12 comprises a substantially cylindrical main body section 20 mounted on a substantially cylindrical lower body section 22. The main body section 20 and the lower body section 22 preferably have substantially the same external diameter so that the external surface of the upper body section 20 is substantially flush with the external surface of the lower body section 22. In this embodiment the body 12 has a height in the range from 100 to 300 mm, and a diameter in the range from 100 to 200 mm.

The main body section 20 comprises the air inlet 14 through which the primary air flow enters the fan assembly 10. In this embodiment the air inlet 14 comprises an array of apertures formed in the main body section 20. Alternatively, the air inlet 14 may comprise one or more grilles or meshes mounted within windows formed in the main body section 20. The main body section 20 is open at the upper end (as illustrated) thereof to provide an air outlet 23 (shown in FIG. 3) through which the primary air flow is exhausted from the body 12.

The main body section 20 may be tilted relative to the lower body section 22 to adjust the direction in which the primary air flow is emitted from the fan assembly 10. For example, the upper surface of the lower body section 22 and the lower surface of the main body section 20 may be provided with interconnecting features which allow the main body section 20 to move relative to the lower body section 22 while preventing the main body section 20 from being lifted from the lower body section 22. For example, the lower body section 22 and the main body section 20 may comprise interlocking L-shaped members.

The lower body section 22 comprises a user interface of the fan assembly 10. The user interface comprises a plurality of user-operable buttons 24, 26, a dial 28 for enabling a user to control various functions of the fan assembly 10, and user interface control circuit 30 connected to the buttons 24, 26 and the dial 28. The lower body section 22 is mounted on a base 32 for engaging a surface on which the fan assembly 10 is located.

Figure 3:
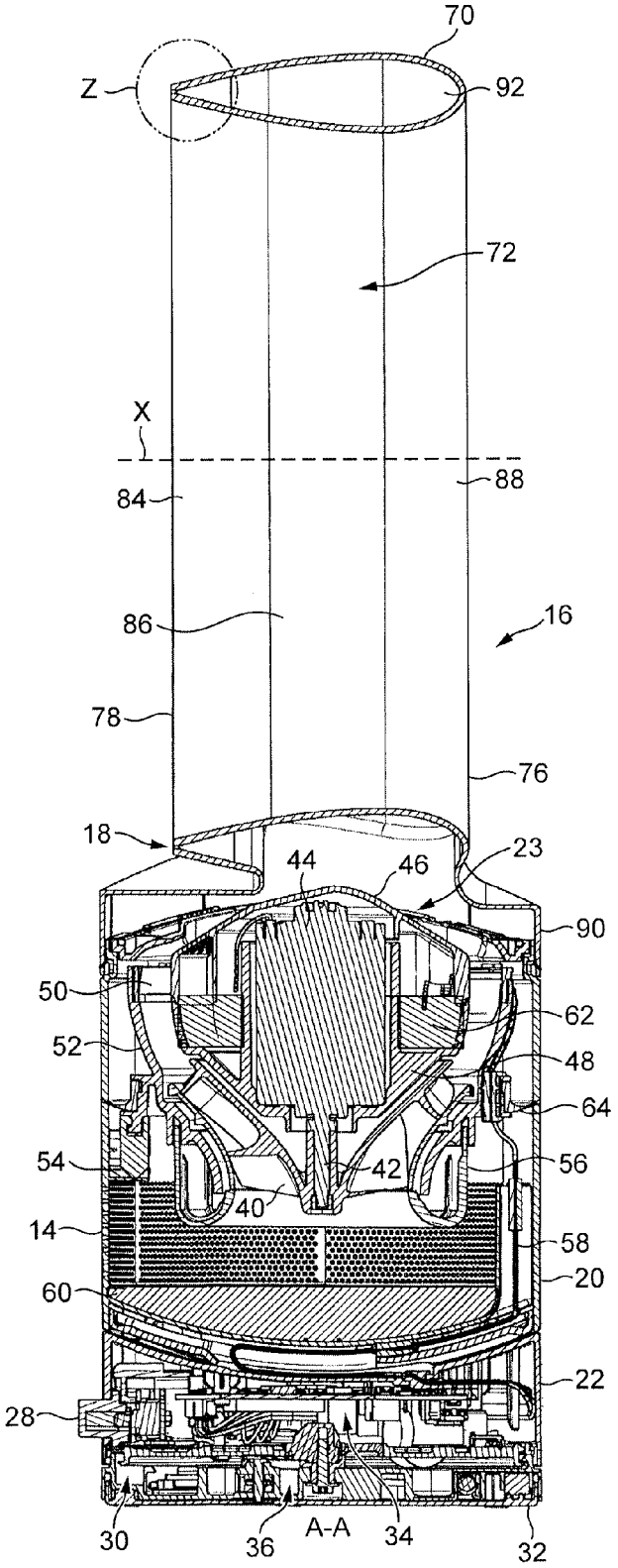
FIG. 3 is a side sectional view take along line A-A in FIG. 2.

FIG. 3 illustrates a sectional view through the fan assembly 10. The lower body section 22 houses a main control circuit, indicated generally at 34, connected to the user interface control circuit 30. In response to operation of the buttons 24, 26 and the dial 28, the user interface control circuit 30 is arranged to transmit appropriate signals to the main control circuit 34 to control various operations of the fan assembly 10.

The lower body section 22 also houses a mechanism, indicated generally at 36, for oscillating the lower body section 22 relative to the base 32. The operation of the oscillating mechanism 36 is controlled by the main control circuit 34 in response to the user operation of the button 26. The range of each oscillation cycle of the lower body section 22 relative to the base 32 is preferably between 60° and 120°, and in this embodiment is around 80°. In this embodiment, the oscillating mechanism 36 is arranged to perform around 3 to 5 oscillation cycles per minute. A mains power cable 38 for supplying electrical power to the fan assembly 10 extends through an aperture formed in the base 32. The cable 38 is connected to a plug (not shown) for connection to a mains power supply.

The main body section 20 houses an impeller 40 for drawing the primary air flow through the air inlet 14 and into the body 12. Preferably, the impeller 40 is in the form of a mixed flow impeller. The impeller 40 is connected to a rotary shaft 42 extending outwardly from a motor 44. In this embodiment, the motor 44 is a DC brushless motor having a speed which is variable by the main control circuit 34 in response to user manipulation of the dial 28. The maximum speed of the motor 44 is preferably in the range from 5,000 to 10,000 rpm. The motor 44 is housed within a motor bucket comprising an upper portion 46 connected to a lower portion 48. The upper portion 46 of the motor bucket comprises a diffuser 50 in the form of a stationary disc having spiral blades.

The motor bucket is located within, and mounted on, a generally frusto-conical impeller housing 52. The impeller housing 52 is, in turn, mounted on a plurality of angularly spaced supports 54, in this example three supports, located within and connected to the main body section 20 of the base 12. The impeller 40 and the impeller housing 52 are shaped so that the impeller 40 is in close proximity to, but does not contact, the inner surface of the impeller housing 52. A substantially annular inlet member 56 is connected to the bottom of the impeller housing 52 for guiding the primary air flow into the impeller housing 52. An electrical cable 58 passes from the main control circuit 34 to the motor 44 through apertures formed in the main body section 20 and the lower body section 22 of the body 12, and in the impeller housing 52 and the motor bucket.

Preferably, the body 12 includes silencing foam for reducing noise emissions from the body 12. In this embodiment, the main body section 20 of the body 12 comprises a first foam member 60 located beneath the air inlet 14, and a second annular foam member 62 located within the motor bucket.

A flexible sealing member 64 is mounted on the impeller housing 52. The flexible sealing member prevents air from passing around the outer surface of the impeller housing 52 to the inlet member 56. The sealing member 64 preferably comprises an annular lip seal, preferably formed from rubber. The sealing member 64 further comprises a guide portion in the form of a grommet for guiding the electrical cable 58 to the motor 44.

Returning to FIGS. 1 and 2, the nozzle 16 has an annular shape. The nozzle 16 comprises an outer wall 70 and an inner wall 72 connected to the outer wall 70 at the rear of the nozzle 16. The outer wall 70 may be integral with the inner wall 72. Alternatively, the outer wall 70 and the inner wall 72 may be separate walls connected at the rear of the nozzle 16, for example using an adhesive. As another alternative, the nozzle 16 may comprise a plurality of annular sections which are connected together, with each section comprising a part of at least one of the outer wall 70 and the inner wall 72. The inner wall 72 extends about a central bore axis X to define a bore 74 of the nozzle 16. The bore 74 has a generally circular cross-section which varies in diameter along the bore axis X from the rear end 76 of the nozzle 16 to the front end 78 of the nozzle 16.

Figure 4:
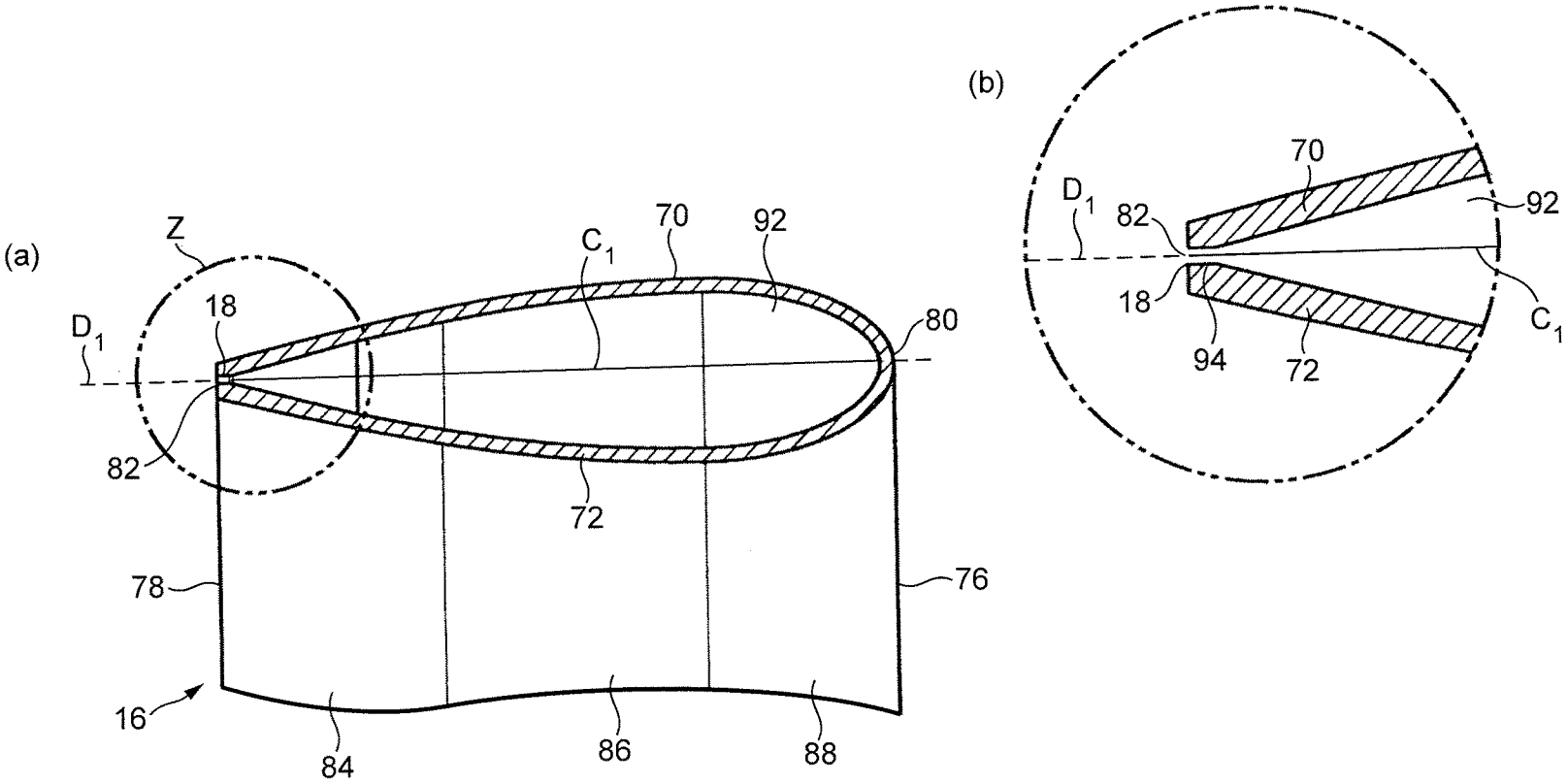
FIG. 4(*a*) is a close up of part of FIG. 3, and FIG. 4(*b*) is a close up of region Z identified in FIG. 4(*a*)
Figure 5:
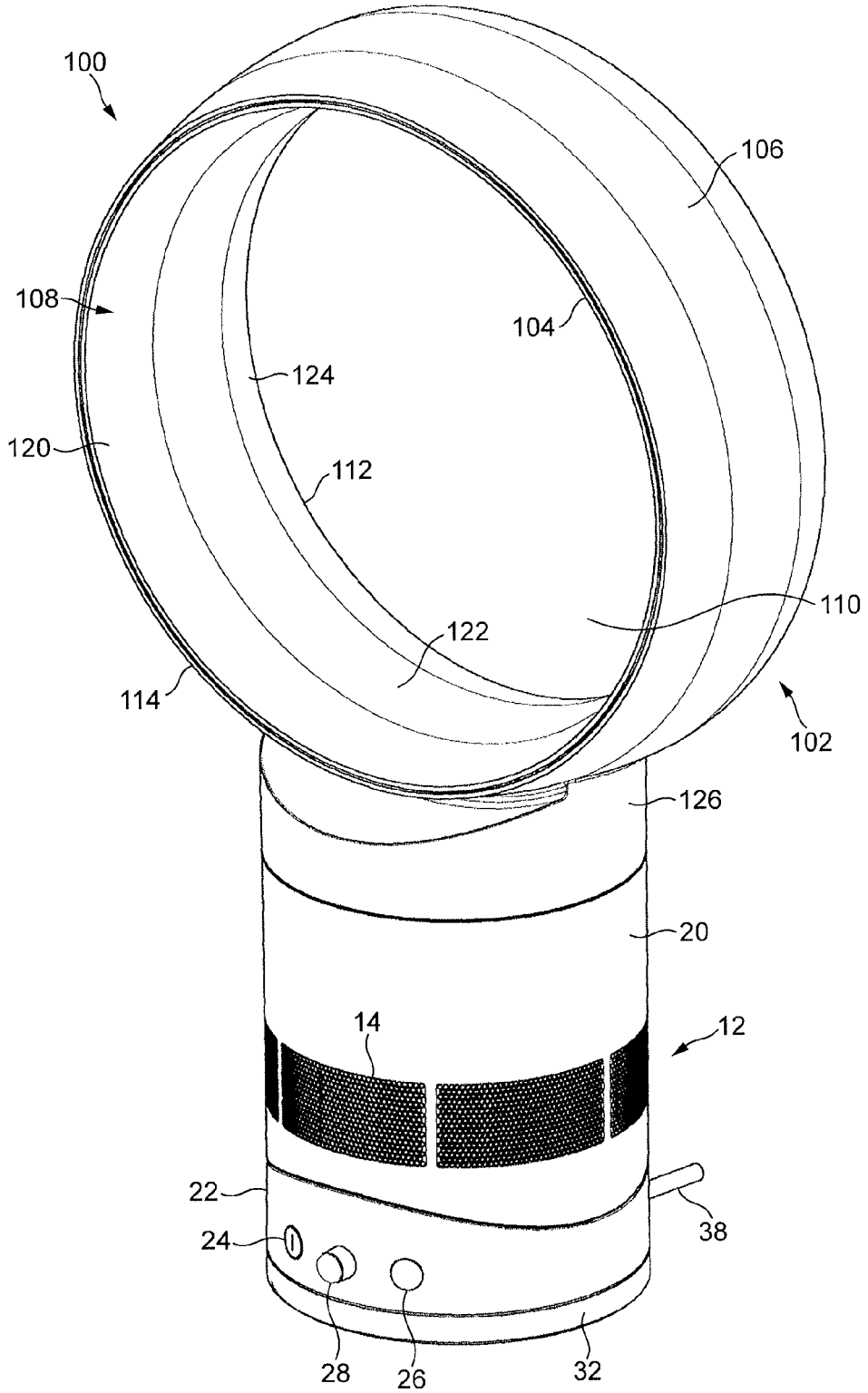
FIG. 5 is a front perspective view of a second embodiment of a fan assembly.
Figure 6:
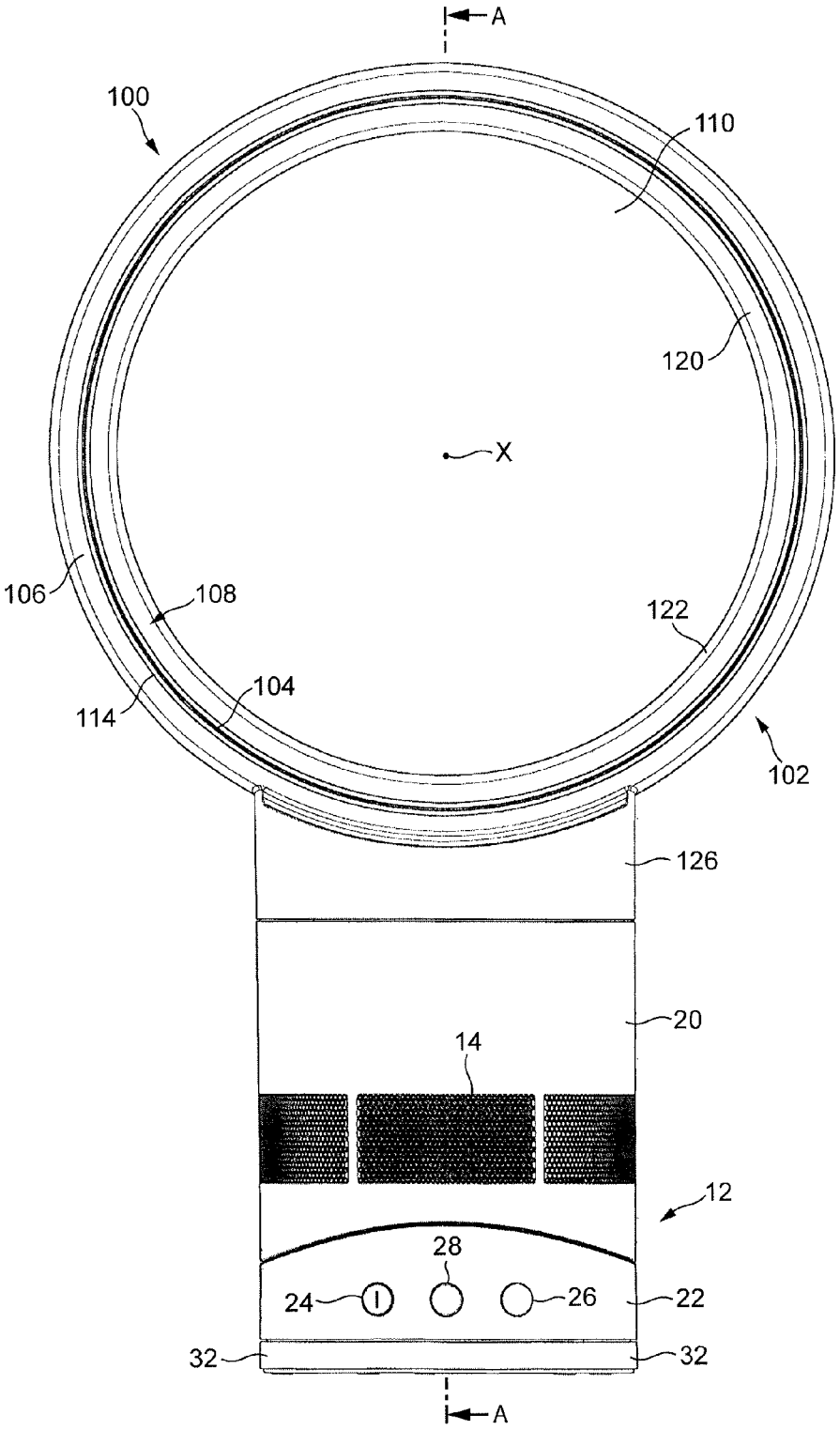
FIG. 6 is a front view of the fan assembly of FIG. 5.

With particular reference to FIGS. 3 and 4(*a*), at least the inner wall 72 has a cross-sectional profile in a plane containing the bore axis X which is in the shape of part of a surface of an airfoil. In this example, the outer and inner walls 70, 72 are in the shape of an airfoil, in this example a symmetrical four-digit NACA airfoil. The airfoil has a leading edge 80 at the rear end 76 of the nozzle 16, a trailing edge 82 at the front end 78 of the nozzle 16, and a chord line $C_1$ extending between the leading edge 80 and the trailing edge 82. In this embodiment, the chord line $C_1$ is parallel to the bore axis X, and so the majority of the inner wall 72 of the nozzle 16 tapers away from the bore axis X. In this embodiment the inner wall 72 has a front section 84, 86 which tapers away from the bore axis X, and a rear section 88 which tapers towards the bore axis X. The front section has a front portion 84 which is generally conical in cross-section, and a rear section 86 which is curved in cross-section and which extends between the front portion 84 and the rear section 88.

The nozzle 16 comprises a base 90 which is connected to the open upper end of the main body section 20 of the body 12, and which has an open lower end for receiving the primary air flow from the body 12. The base 90 is shaped to convey the primary air flow into an annular interior passage 92 of the nozzle 16. The outer wall 70 and the inner wall 72 of the nozzle 16 together define the interior passage 92, which extends about the bore axis X. The air outlet 18 of the nozzle 16 is located at the front end 78 of the nozzle 16, and is located on the chord line $C_1$ of the airfoil. The air outlet 18 is preferably in the form of an annular slot. The slot is preferably generally circular in shape, and located in a plane which is perpendicular to the bore axis X. The slot preferably has a relatively constant width in the range from 0.5 to 5 mm. In this example the air outlet 18 has a width of around 1 mm.

As shown in FIG. 4(*b*), the interior passage 92 comprises a narrow air channel 94 for directing the primary air flow through the air outlet 18. The air channel 94 is tubular in shape, and lies on the chord line $C_1$ of the airfoil. The width of the air channel 94 is the same as the width of the air outlet 18. As viewed in a plane which contains the bore axis X of the nozzle 16, the air channel 94 extends in a direction $D_1$, indicated in FIG. 4(*b*), which is parallel to, and generally co-linear with, the chord line $C_1$ of the airfoil so that the primary air flow is emitted through the air outlet 18 in the direction $D_1$.

To operate the fan assembly 10 the user the user presses button 24 of the user interface. The user interface control circuit 30 communicates this action to the main control circuit 34, in response to which the main control circuit 34 activates the motor 44 to rotate the impeller 40. The rotation of the impeller 40 causes a primary air flow to be drawn into the body 12 through the air inlet 14. The user may control the speed of the motor 44, and therefore the rate at which air is drawn into the body 12 through the air inlet 14, by manipulating the dial 28 of the user interface. Depending on the speed of the motor 44, the primary air flow generated by the impeller 40 may be between 10 and 30 liters per second. The primary air flow passes sequentially through the impeller housing 52 and the air outlet 23 at the open upper end of the main body portion 20 to enter the interior passage 92 of the nozzle 16. The pressure of the primary air flow at the air outlet 23 of the body 12 may be at least 150 Pa, and is preferably in the range from 250 to 1.5 kPa.

Within the interior passage 92 of the nozzle 16, the primary air flow is divided into two air streams which pass in opposite directions around the bore 74 of the nozzle 16. As the air streams pass through the interior passage 88, air is emitted through the air outlet 18. As viewed in a plane passing through and containing the bore axis X, the primary air flow is emitted through the air outlet 18 in the direction $D_1$. The emission of the primary air flow from the air outlet 18 causes a secondary air flow to be generated by the entrainment of air from the external environment, specifically from the region around the nozzle 16. This secondary air flow combines with the primary air flow to produce a combined, or total, air flow, or air current, projected forward from the nozzle 16.

With reference now to FIGS. 5 to 8, a second embodiment of a fan assembly 100 will now be described. Similar to the first embodiment, the fan assembly 100 comprises a body 12 comprising an air inlet 14 through which a primary air flow enters the fan assembly 10, and an annular nozzle 102 mounted on the body 12, the nozzle 102 comprising an air outlet 104 for emitting the primary air flow from the fan assembly 10. The base 12 of the fan assembly 100 is the same as the base 12 of the fan assembly 10, and so will not be described again.

The nozzle 102 has generally the same shape as the nozzle 16 of the fan assembly 10. In more detail, the nozzle 102 comprises an outer wall 106 and an inner wall 108 connected to the outer wall 106 at the rear of the nozzle 102. The inner wall 108 extends about a central bore axis X to define a bore 110 of the nozzle 102. The bore 110 has a generally circular cross-section which varies in diameter along the bore axis X from the rear end 112 of the nozzle 102 to the front end 114 of the nozzle 102.

Figure 7:
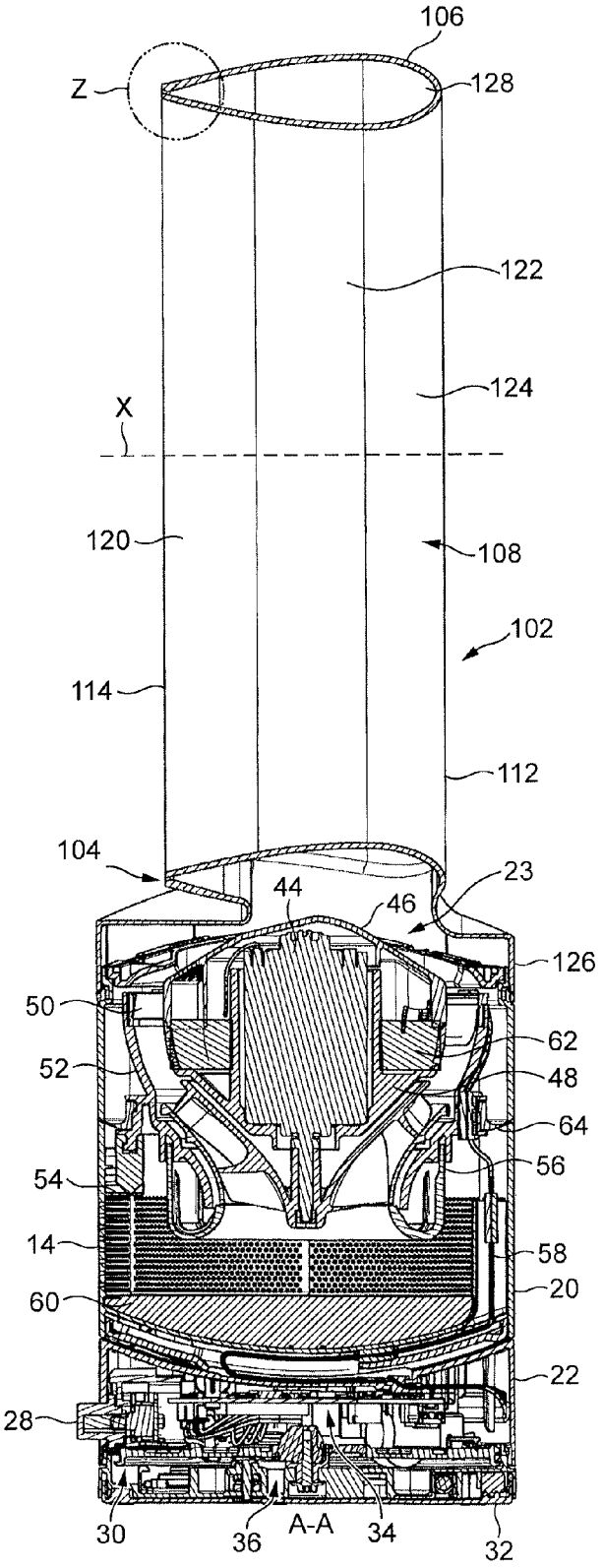
FIG. 7 is a side sectional view take along line A-A in FIG. 6.
Figure 8:
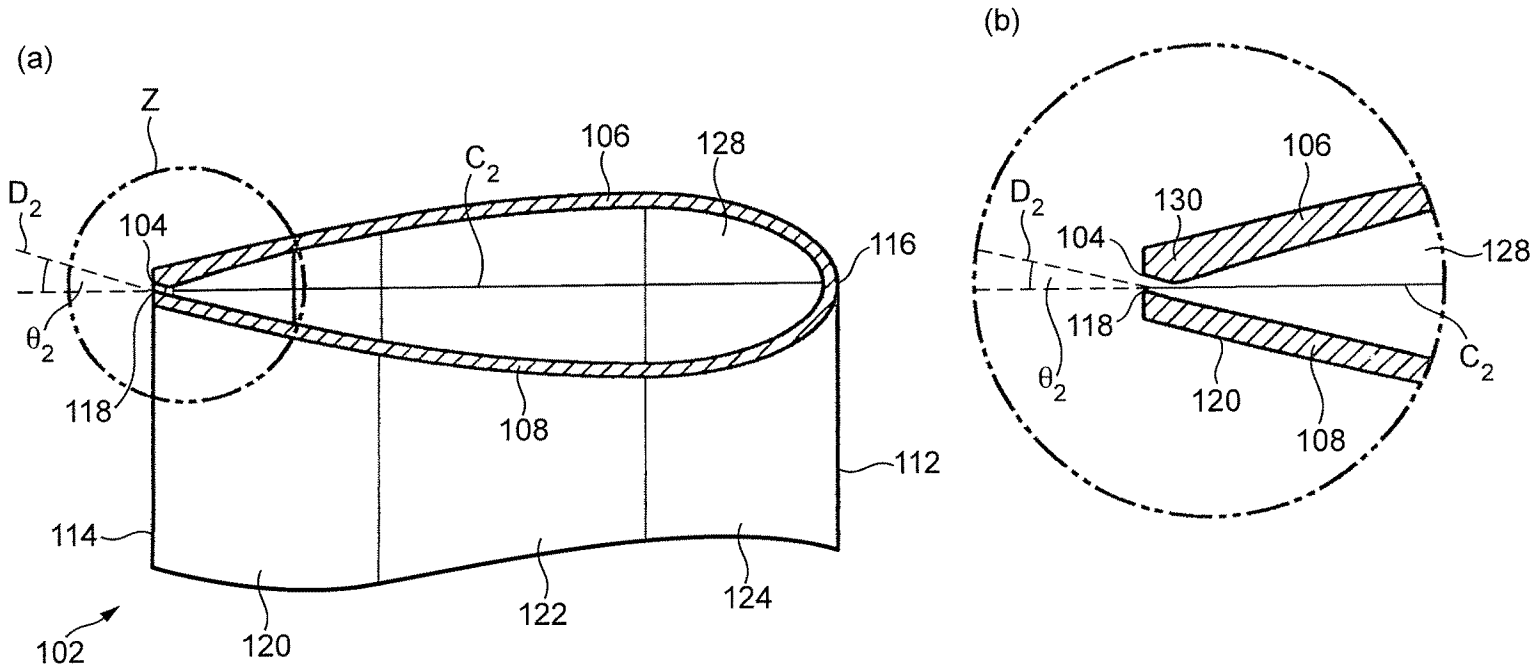
FIG. 8(*a*) is a close up of part of FIG. 7, and FIG. 8(*b*) is a close up of region Z identified in FIG. 8(*a*)
Figure 9:
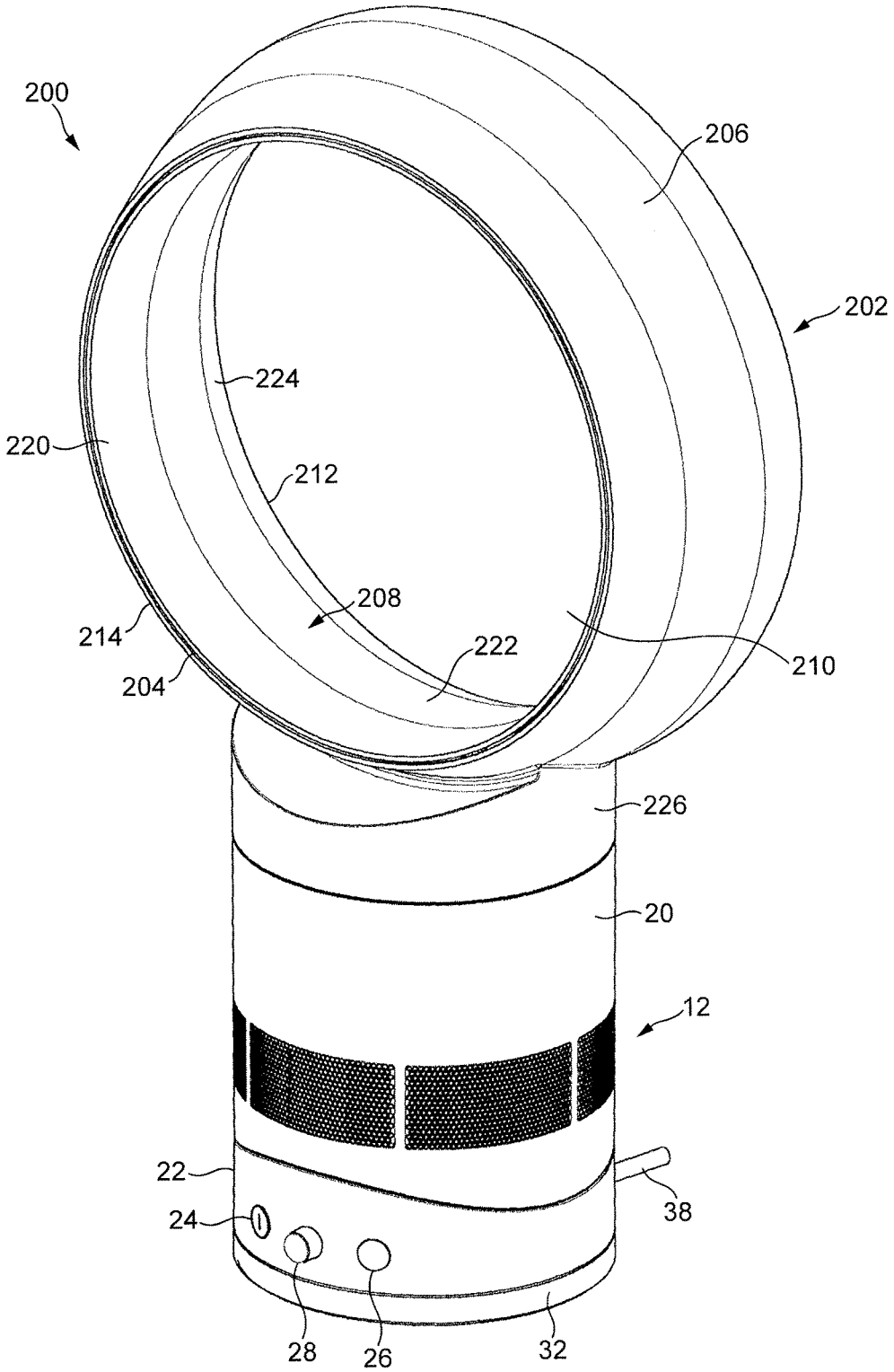
FIG. 9 is a front perspective view of a third embodiment of a fan assembly.
Figure 10:
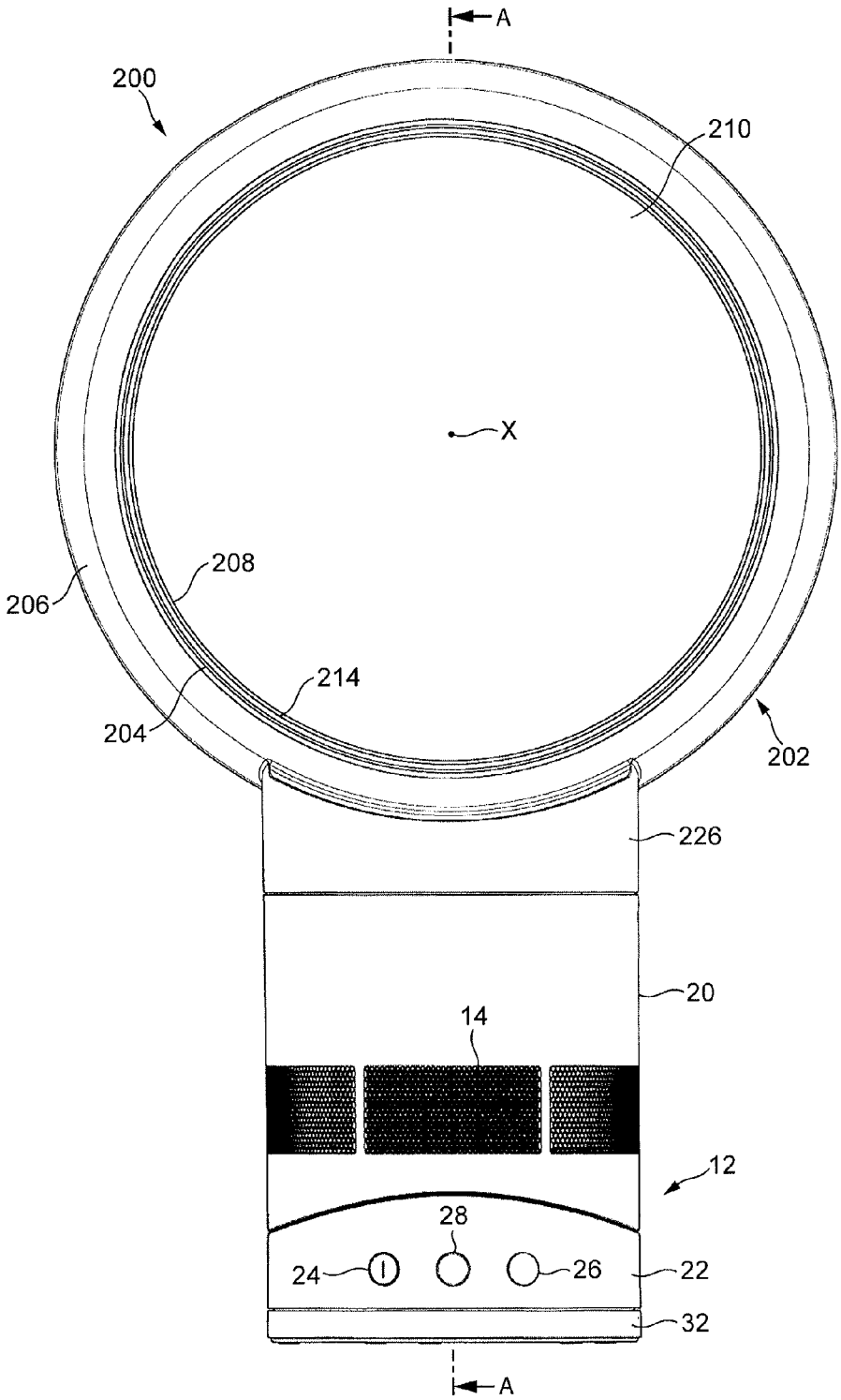
FIG. 10 is a front view of the fan assembly of FIG. 9.

With particular reference to FIGS. 7 and 8(*a*), at least the inner wall 108 has a cross-sectional profile in a plane containing the bore axis X which is in the shape of part of a surface of an airfoil. In this example, the outer and inner walls 106, 108 are in the shape of an airfoil, in this example a symmetrical four-digit NACA airfoil which is substantially the same as that of the airfoil of the nozzle 12. The airfoil has a leading edge 116 at the rear end 112 of the nozzle 102, a trailing edge 118 at the front end 114 of the nozzle 102, and a chord line $C_2$ extending between the leading edge 116 and the trailing edge 118. In this embodiment, the chord line $C_2$ is parallel to the bore axis X, and so the majority of the inner wall 108 of the nozzle 102 tapers away from the bore axis X. In this embodiment the inner wall 102 has a front section 120, 122 which tapers away from the bore axis X, and a rear section 124 which tapers towards the bore axis X. The front section has a front portion 120 which is generally conical in cross-section, and a rear section 122 which is curved in cross-section and which extends between the front portion 120 and the rear section 124. In this embodiment, an angle subtended between the front portion 120 of the inner wall 108 and the bore axis X is around 16°.

The nozzle 102 comprises a base 126 which is connected to the open upper end of the main body section 20 of the body 12, and which has an open lower end for receiving the primary air flow from the body 12. The base 126 is shaped to convey the primary air flow into an annular interior passage 128 of the nozzle 102. The outer wall 106 and the inner wall 108 of the nozzle 102 together define the interior passage 128, which extends about the bore axis X. The shape and volume of the interior passage 128 is substantially the same as the shape and volume of the interior passage 92 of the nozzle 16.

The air outlet 104 of the nozzle 102 is located at the front end 114 of the nozzle 102, and at the trailing edge 118 of the airfoil. The air outlet 104 is preferably in the form of an annular slot. The slot is preferably generally circular in shape, and located in a plane which is perpendicular to the bore axis X. The slot preferably has a relatively constant width in the range from 0.5 to 5 mm. In this example the air outlet 104 has a width of around 1 mm. The diameter of the air outlet 104 is substantially the same as the diameter of the air outlet 18.

As shown in FIG. 8(*b*), the interior passage 128 comprises an air channel 130 for directing the primary air flow through the air outlet 104. The width of the air channel 130 is substantially the same as the width of the air outlet 104. In this embodiment the air channel 130 extends towards the air outlet 104 in a direction $D_2$ extending away from the bore axis X so that the air channel 130 is inclined to the chord line $C_2$ of the airfoil, and to the bore axis X of the nozzle 102. The shape of the air channel 130 is such that the cross-sectional area of the air channel 130, as viewed in a plane which is orthogonal to the bore axis X, increases towards the air outlet 104.

The angle of inclination $\theta_2$ of the bore axis X, or the chord line $C_2$, to the direction $D_2$ may take any value. The angle is preferably in the range from 0 to 45°. In this embodiment the angle of inclination $\theta_2$ is substantially constant about the bore axis X, and is around 16°. The inclination of the air channel 130 to the bore axis X is thus substantially the same as the inclination of the front portion 120 of the inner wall 108 to the bore axis X.

The primary air flow is thus emitted from the nozzle 102 in a direction $D_2$ which is inclined to the chord line $C_2$ of the airfoil, and to the bore axis X of the nozzle 104. The primary air flow is also emitted away from the inner wall 108 of the nozzle 104. By adjusting the shape of the air channel 130 so that the air channel 130 extends away from the bore axis X, the flow rate of the combined air flow generated by the fan assembly 100 can be increased in comparison to that of the combined air flow generated by the fan assembly 10 for a given flow rate of the primary air flow. Without wishing to be bound by any theory we consider this to be due to the greater surface area of the outer profile of the primary air flow emitted from the fan assembly 100. In this second embodiment, the primary air flow is emitted from the nozzle 102 generally in the shape of an outwardly tapering cone. This increased surface area promotes mixing of the primary air flow with air surrounding the nozzle 102, increasing the entrainment of the secondary air flow by the primary air flow and thereby increasing the flow rate of the combined air flow.

With reference now to FIGS. 9 to 12, a third embodiment of a fan assembly 200 will now be described. Similar to the first and second embodiments, the fan assembly 200 comprises a body 12 comprising an air inlet 14 through which a primary air flow enters the fan assembly 10, and an annular nozzle 202 mounted on the body 12, the nozzle 202 comprising an air outlet 204 for emitting the primary air flow from the fan assembly 10. The base 12 of the fan assembly 200 is the same as the base 12 of the fan assembly 10, and so will not be described again.

The nozzle 202 has a shape which is slightly different from that of the nozzles 16, 102 described above. Similar to those nozzle 16, 102, the nozzle 202 comprises an outer wall 206 and an inner wall 208 connected to the outer wall 206 at the rear of the nozzle 202. The inner wall 208 extends about a central bore axis X to define a bore 210 of the nozzle 202. The bore 210 has a generally circular cross-section which varies in diameter along the bore axis X from the rear end 212 of the nozzle 202 to the front end 214 of the nozzle 202.

Figure 11:
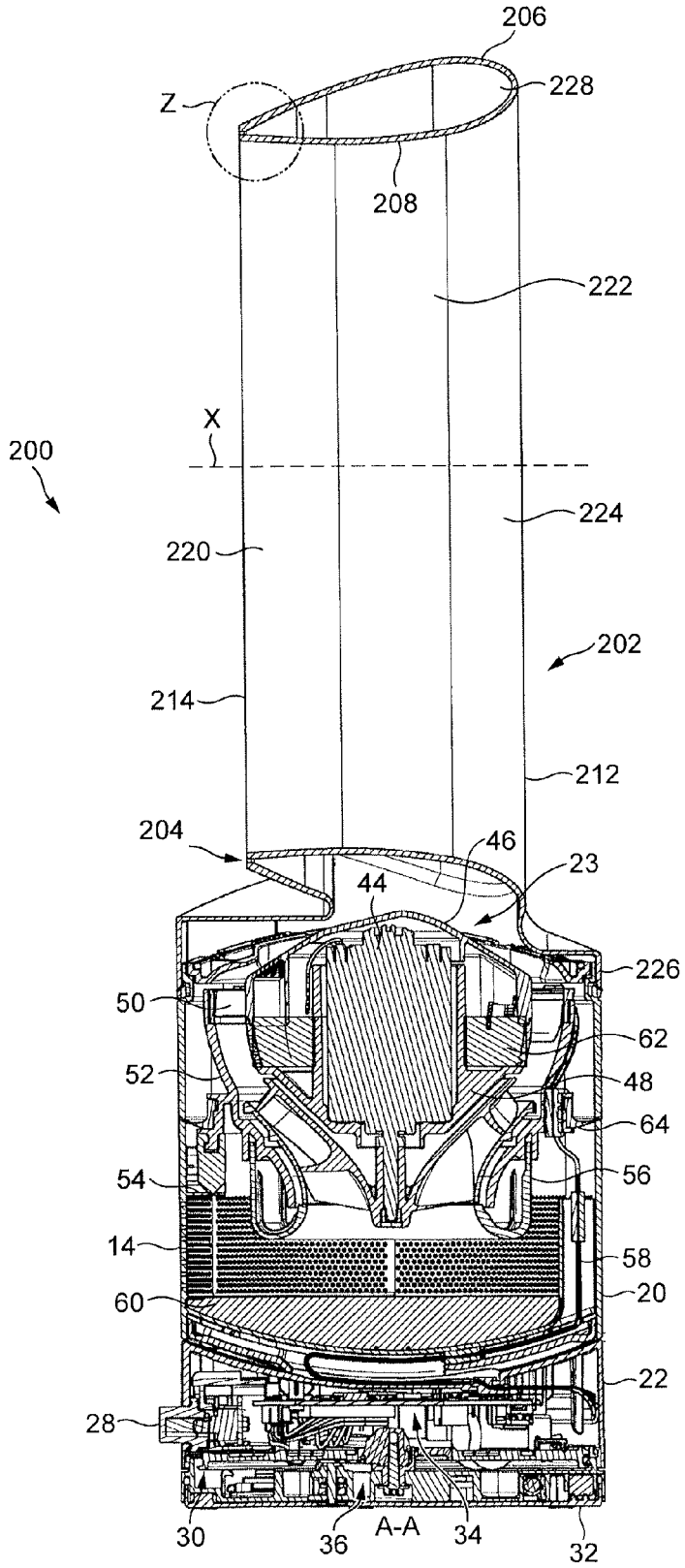
FIG. 11 is a side sectional view take along line A-A in FIG. 10.
Figure 12:
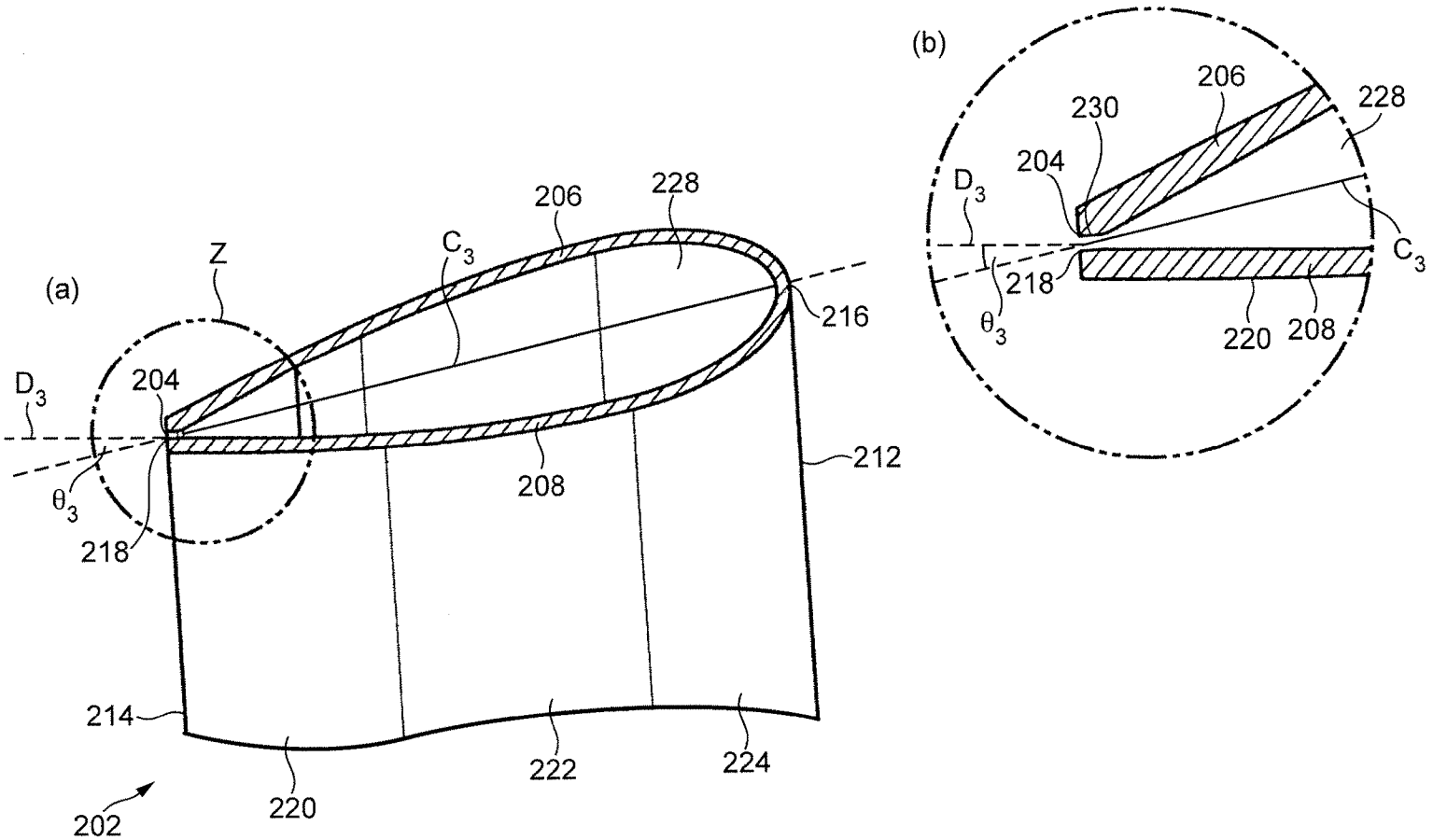
FIG. 12(*a*) is a close up of part of FIG. 11, and FIG. 12(*b*) is a close up of region Z identified in FIG. 12(*a*)
Figure 13:
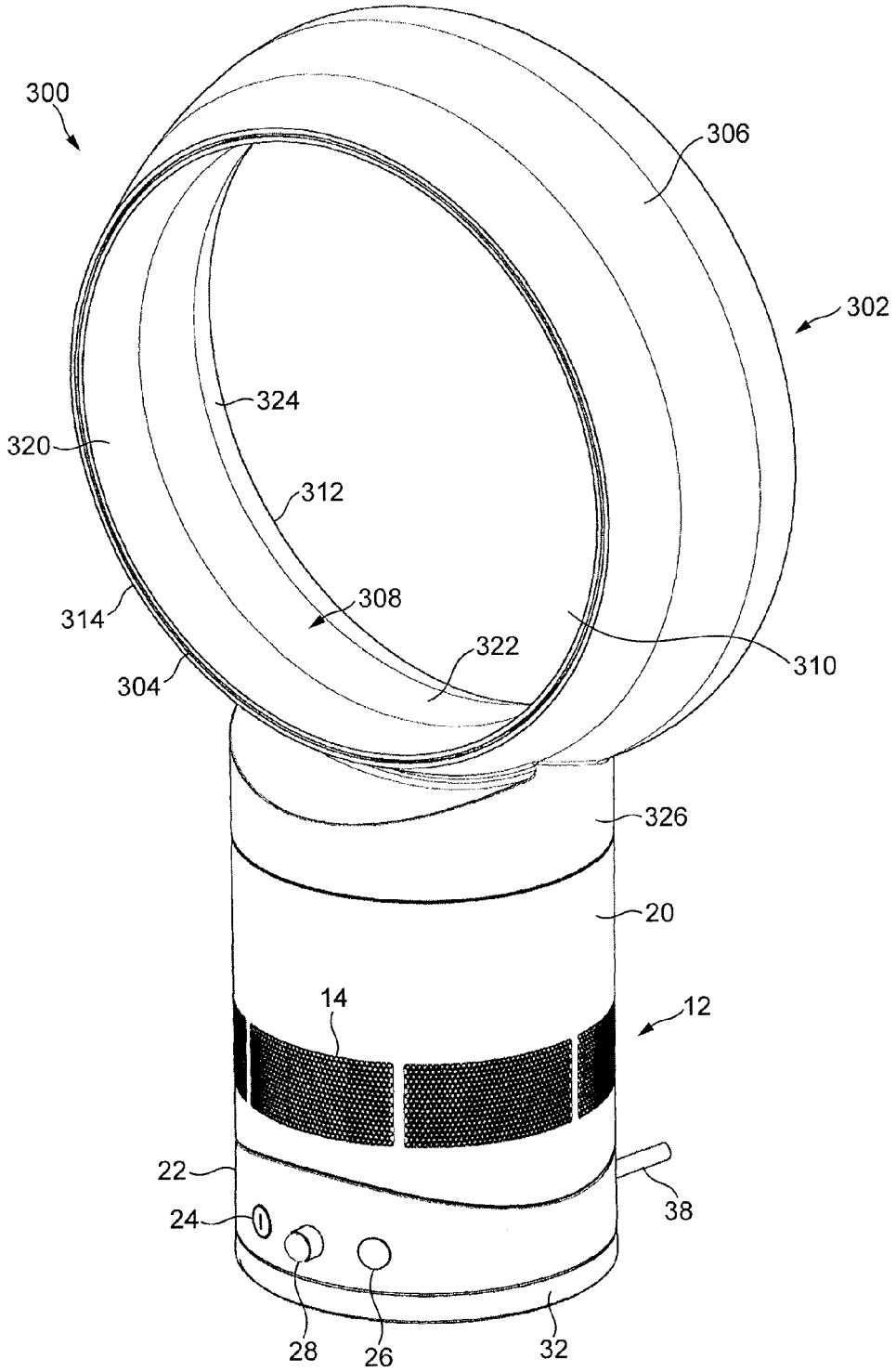
FIG. 13 is a front perspective view of a fourth embodiment of a fan assembly.
Figure 14:
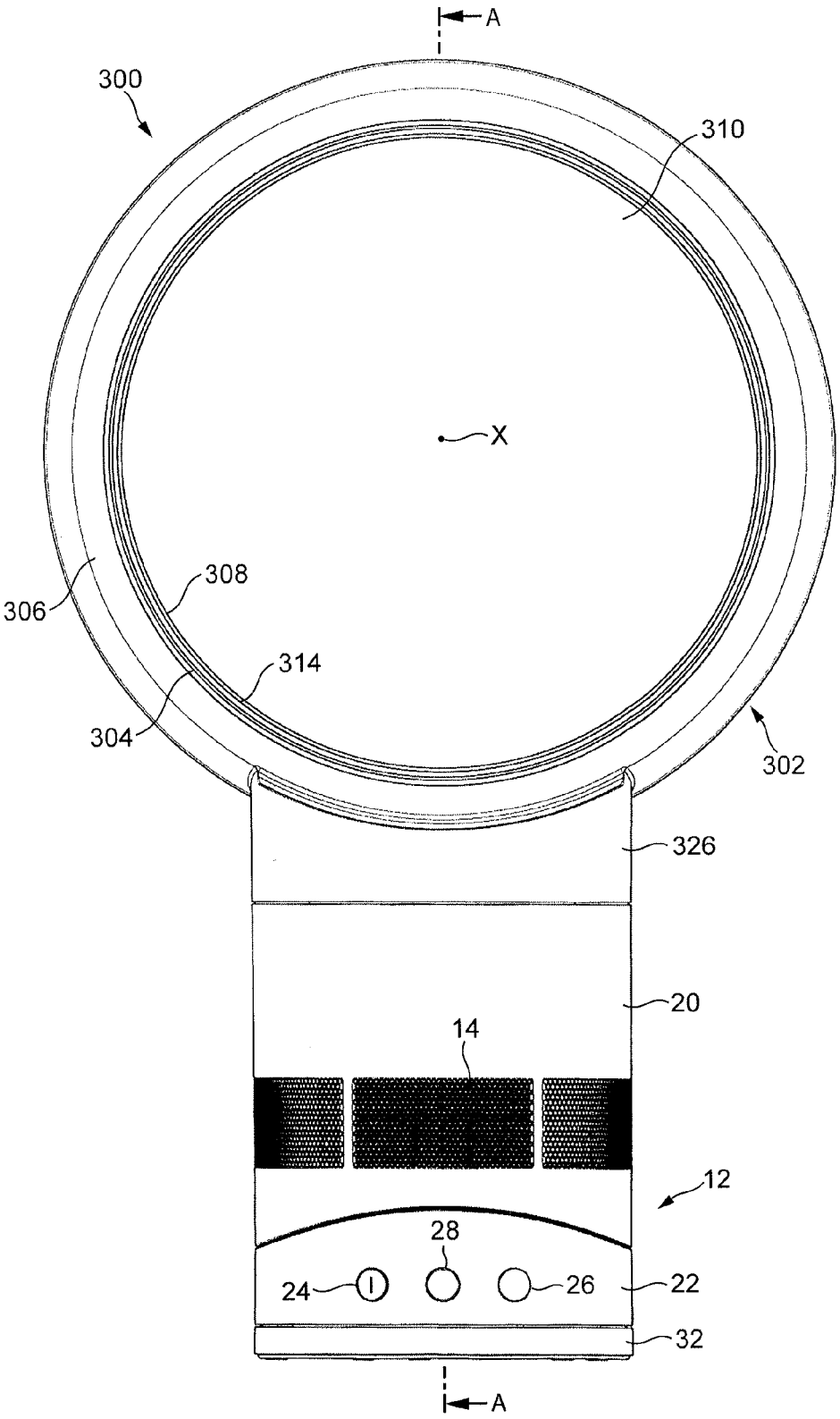
FIG. 14 is a front view of the fan assembly of FIG. 13.

With particular reference to FIGS. 11 and 12(*a*), at least the inner wall 208 has a cross-sectional profile in a plane containing the bore axis X which is in the shape of part of a surface of an airfoil. In this example, the outer and inner walls 206, 208 are in the shape of an airfoil, in this example a symmetrical four-digit NACA airfoil. The airfoil has a leading edge 216 at the rear end 212 of the nozzle 202, a trailing edge 218 at the front end 214 of the nozzle 202, and a chord line $C_3$ extending between the leading edge 216 and the trailing edge 218.

The chord line $C_3$ is inclined to the bore axis X. An angle subtended between the chord line $C_3$ and the bore axis X may take any value. This value is preferably in the range from 0 to 45°. In this embodiment, the chord line $C_3$ is inclined towards the bore axis X in a direction extending from the leading edge 216 to the trailing edge 218, and at an angle of around 16°. A result of this is that a majority of the inner wall 208 of the nozzle 202 tapers towards the bore axis X. In this embodiment the inner wall 202 has a front section 220, which tapers away from the bore axis X, and a rear section 222, 224 which tapers towards the bore axis X. The front section 220 is generally conical in cross-section, and an angle subtended between the front portion 220 of the inner wall 208 and the bore axis X is in the range from 0 to 5°.

As above, the nozzle 202 comprises a base 226 which is connected to the open upper end of the main body section 20 of the body 12, and which has an open lower end for receiving the primary air flow from the body 12. The base 226 is shaped to convey the primary air flow into an annular interior passage 228 of the nozzle 202. The outer wall 206 and the inner wall 208 of the nozzle 202 together define the interior passage 228, which extends about the bore axis X. The volume of the interior passage 228 is substantially the same as the volume of the interior passages 92, 128 of the nozzles 16, 102 of the first and second embodiments.

The air outlet 204 of the nozzle 202 is located at the front end 214 of the nozzle 202, and at the trailing edge 218 of the airfoil. The air outlet 204 is preferably in the form of an annular slot. The slot is preferably generally circular in shape, and located in a plane which is perpendicular to the bore axis X. The slot preferably has a relatively constant width in the range from 0.5 to 5 mm. In this example the air outlet 204 has a width of around 1 mm. The diameter of the air outlet 204 is substantially the same as the diameter of the air outlets 18, 104 of the first and second embodiments.

As shown in FIG. 12(*b*), the interior passage 228 comprises an air channel 230 for directing the primary air flow through the air outlet 204. The width of the air channel 230 is substantially the same as the width of the air outlet 204. However, in this embodiment the air channel 230 is generally tubular in shape, and extends to the air outlet 204 in a direction $D_3$ extending generally parallel to the bore axis X. The air channel 230 is thus inclined to the chord line $C_3$ of the airfoil. In this embodiment, the angle of inclination $\theta_3$ of the chord line $C_3$ to the direction $D_3$, in which the primary air flow is emitted through the air outlet 204, is substantially constant about the bore axis X, and is around 16°.

The inclination of the air channel 230 away from the chord line $C_3$ of the airfoil thus causes the air flow to be emitted from the front end 214 of the nozzle 202 generally in the shape of a cylinder, but again away from the inner wall 208 of the nozzle 202. On the other hand, had the air channel 230 been arranged similar to the air channel 94 of the nozzle 16, that is, extending in a direction along the chord line $C_3$ of the airfoil, the air flow would have been emitted from the front end 214 of the nozzle 202 generally in the shape of an inwardly tapering cone. As a result of the increased surface area of the outer profile of the primary air flow which is generated through the inclination of the air channel 230 away from the chord line $C_3$ of the airfoil, the flow rate of the combined air flow generated by the fan assembly 200 can be increased.

With reference now to FIGS. 13 to 16, a fourth embodiment of a fan assembly 300 will now be described. Similar to the first to third embodiments, the fan assembly 300 comprises a body 12 comprising an air inlet 14 through which a primary air flow enters the fan assembly 10, and an annular nozzle 302 mounted on the body 12, the nozzle 302 comprising an air outlet 304 for emitting the primary air flow from the fan assembly 10. The base 12 of the fan assembly 300 is the same as the base 12 of the fan assembly 10, and so will not be described again.

The nozzle 302 has a shape which is similar to that of the nozzle 202 of the fan assembly 200. The nozzle 302 comprises an outer wall 306 and an inner wall 308 connected to the outer wall 306 at the rear of the nozzle 302. The inner wall 308 extends about a central bore axis X to define a bore 310 of the nozzle 302. The bore 310 has a generally circular cross-section which varies in diameter along the bore axis X from the rear end 312 of the nozzle 302 to the front end 314 of the nozzle 302.

Figure 15:
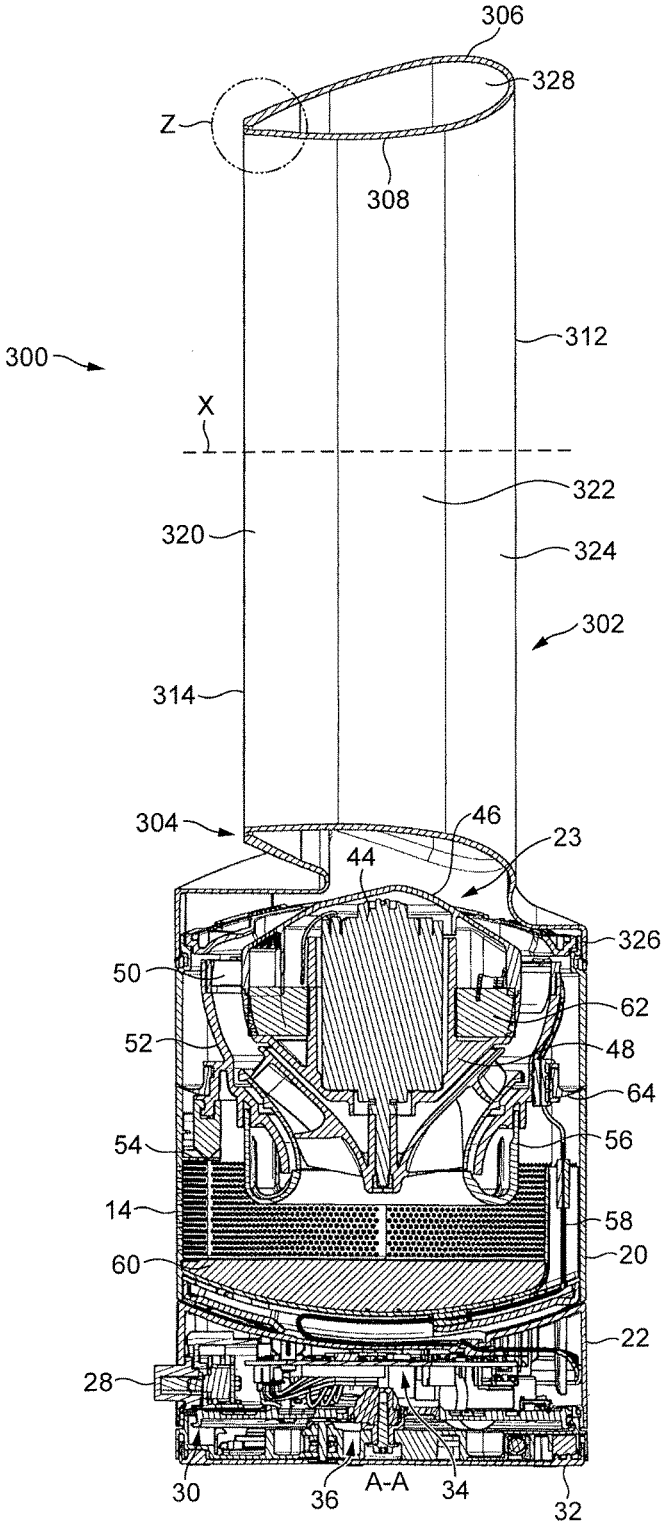
FIG. 15 is a side sectional view take along line A-A in FIG. 14.
Figure 16:
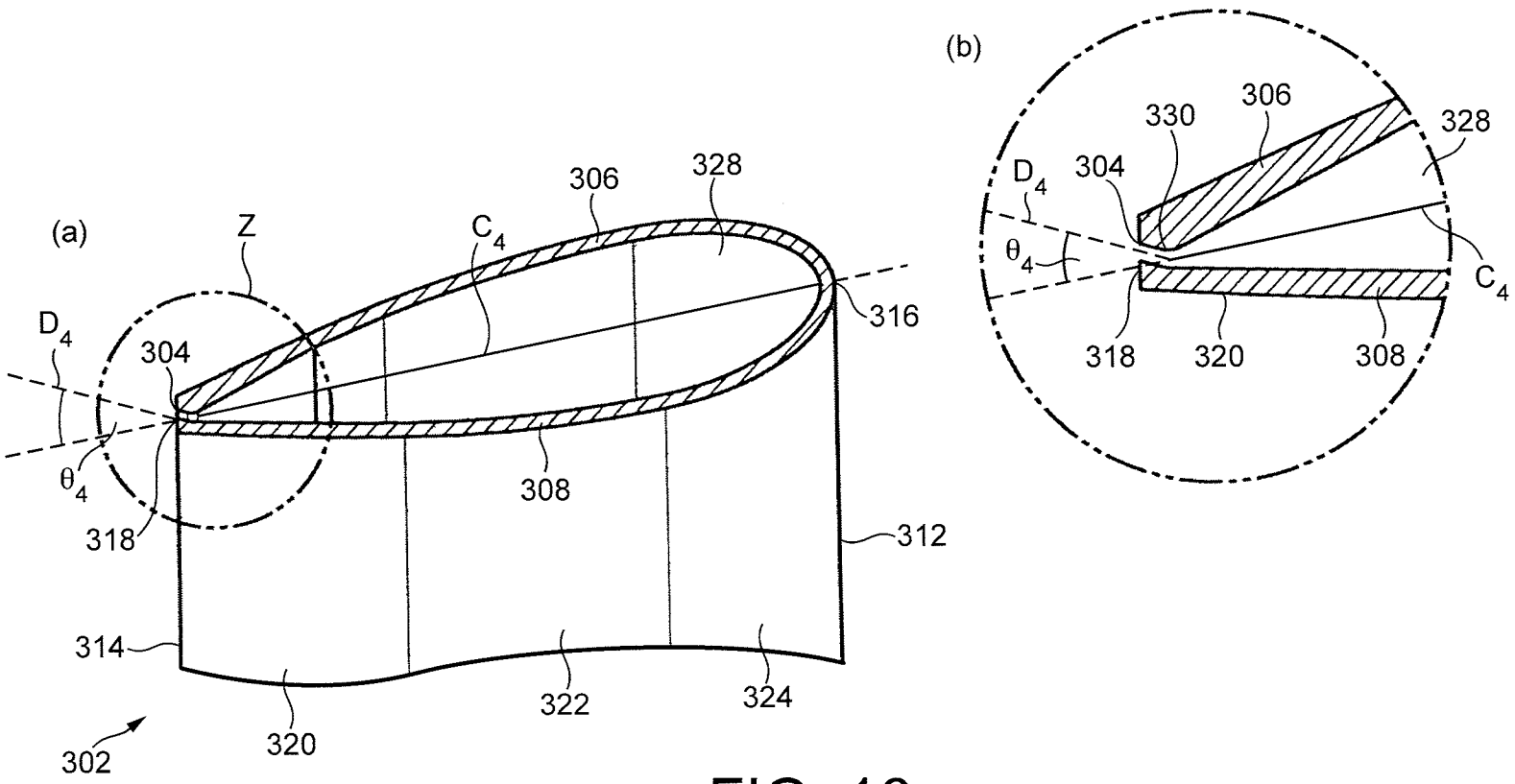
FIG. 16(*a*) is a close up of part of FIG. 15, and FIG. 16(*b*) is a close up of region Z identified in FIG. 16(*a*).

With particular reference to FIGS. 15 and 16(*a*), at least the inner wall 308 has a cross-sectional profile in a plane containing the bore axis X which is in the shape of part of a surface of an airfoil. In this example, the outer and inner walls 306, 308 are in the shape of an airfoil, in this example a symmetrical four-digit NACA airfoil.

The airfoil has a leading edge 316 at the rear end 312 of the nozzle 302, a trailing edge 318 at the front end 314 of the nozzle 302, and a chord line $C_4$ extending between the leading edge 316 and the trailing edge 318. As in the third embodiment, the chord line $C_4$ is inclined to the bore axis X. Also in this embodiment, the chord line $C_4$ is inclined towards the bore axis X in a direction extending from the leading edge 316 to the trailing edge 318, and at an angle of around 16°. Consequently, again a majority of the inner wall 308 of the nozzle 302 tapers towards the bore axis X. In this embodiment the inner wall 302 has a front section 320, which tapers away from the bore axis X, and a rear section 322, 324 which tapers towards the bore axis X. The front section 320 is generally conical in cross-section, and an angle subtended between the front portion 320 of the inner wall 308 and the bore axis X is in the range from 0 to 5°.

As above, the nozzle 302 comprises a base 326 which is connected to the open upper end of the main body section 20 of the body 12, and which has an open lower end for receiving the primary air flow from the body 12. The base 326 is shaped to convey the primary air flow into an annular interior passage 328 of the nozzle 302. The outer wall 306 and the inner wall 308 of the nozzle 302 together define the interior passage 328, which extends about the bore axis X. The size and volume of the interior passage 328 is substantially the same as the volume of the interior passages 228 of the nozzle 200.

The air outlet 304 of the nozzle 302 is located at the front end 314 of the nozzle 302, at the trailing edge 318 of the airfoil. The air outlet 304 is preferably in the form of an annular slot. The slot is preferably generally circular in shape, and located in a plane which is perpendicular to the bore axis X. The slot preferably has a relatively constant width in the range from 0.5 to 5 mm. In this example the air outlet 304 has a width of around 1 mm. The diameter of the air outlet 304 is substantially the same as the diameter of the air outlets 18, 104, 204 of the first to third embodiments.

As shown in FIG. 16(*b*), the interior passage 328 comprises an air channel 330 for directing the primary air flow through the air outlet 304. The width of the air channel 330 is substantially the same as the width of the air outlet 304. However, in this fourth embodiment, and similar to the second embodiment, the air channel 330 extends to the air outlet 304 in a direction $D_4$ extending away from both the bore axis X and the chord line $C_4$. In this embodiment, the angle of inclination of the bore axis X to the direction $D_4$, in which the air flow is emitted through the air outlet 304, is different from the angle of inclination of the chord line $C_4$ to the direction $D_4$. In this embodiment, the angle of inclination $\theta_4$ of the chord line $C_4$ to the direction $D_4$, in which the primary air flow is emitted through the air outlet 304, is substantially constant about the bore axis X, and is around 32°, whereas, due to the inclination of the chord line $C_4$ to the bore axis X, the angle of inclination of the bore axis X to the direction $D_4$ is around 16°. Furthermore, due to the relatively large value of the angle of inclination $\theta_4$ of the chord line $C_4$ to the direction $D_4$ in which the air channel 330 extends to the air outlet 304, the air outlet 304 is spaced from the chord line $C_4$. Again, the primary air flow is emitted away from the inner wall 308 of the nozzle 304.

The increased inclination of the air channel 330 away from the chord line in comparison to the third embodiment thus causes the air flow to be emitted from the front end 314 of the nozzle 302 generally in the shape of an outwardly flared cone, as in the second embodiment. As a result of the increased surface area of the outer profile of the primary air flow which is generated through the inclination of the air channel 330 away from the bore axis X, the flow rate of the combined air flow generated by the fan assembly 300 can be increased in comparison to that of the combined air flow generated by the fan assembly 200.

The invention claimed is:

1. An annular nozzle for a fan assembly, the nozzle comprising:

an outer wall and an inner wall surrounded by the outer wall, the inner wall defining a bore having a bore axis and having a cross-sectional profile in a plane containing the bore axis which is in a shape of part of a surface of an airfoil, wherein the airfoil has a leading edge, a trailing edge, and a chord line extending between the leading edge and the trailing edge, wherein the chord line extends in a direction from the leading edge to the trailing edge towards the bore axis;

an air outlet located at or towards the trailing edge of the airfoil for emitting an air flow; and an interior passage located between the inner and outer walls, and extending about the bore axis for receiving the air flow, wherein the interior passage comprises an air channel that extends towards the air outlet in a direction extending away from the chord line such that the air flow emitted from the air outlet is in the direction extending away from the chord line and the bore axis, the extending direction of the chord line, and the extending direction of the air channel are nonparallel.

2. The nozzle of claim 1, wherein the inner wall comprises a front section and a rear section, and wherein the front section of the inner wall has a shape which is substantially conical.

3. The nozzle of claim 2, wherein an angle of inclination of the front section of the inner wall to the bore axis is between 0 and 45°.

4. The nozzle of claim 1, wherein the airfoil has the shape of a NACA airfoil.

5. The nozzle of claim 1, wherein an angle subtended between the bore axis and the direction in which the air flow is emitted from through the air outlet is between 0 and 45°.

6. The nozzle of claim 1, wherein the air outlet extends about the bore axis.

7. The nozzle of claim 6, wherein the air outlet is generally annular in shape.

8. The nozzle of claim 1, wherein the air channel is inclined to the bore axis.

9. The nozzle of claim 1, wherein the air channel has a shape which is convergent.

10. The nozzle of claim 1, wherein an angle subtended between the air channel and the bore axis is in the range from 0 to 45°.

11. The nozzle of claim 1, wherein a majority of the inner wall tapers towards the bore axis.

12. The nozzle of claim 1, wherein the angle subtended between the bore axis and the direction in which the air flow is emitted from the air outlet is substantially constant about the bore axis.

13. The nozzle of claim 1, wherein the angle subtended between the bore axis and the direction in which the air flow is emitted from the air outlet varies about the bore axis.

14. The nozzle of claim 13, wherein the angle subtended between the bore axis and the direction in which the air flow is emitted from the air outlet varies about the bore axis between at least one maximum value and at least one minimum value.

15. The nozzle of claim 13, wherein the angle subtended between the bore axis and the direction in which the air flow is emitted from the air outlet varies about the bore axis between a plurality of maximum values and a plurality of minimum values.

16. The nozzle of claim 15, wherein the maximum values and the minimum values are regularly spaced about the bore axis.

17. The nozzle of claim 15, wherein the angle is at a minimum value at or towards at least one of an upper extremity and a lower extremity of the nozzle.

18. A fan assembly comprising a system for creating an air flow and the nozzle of claim 1 for emitting the air flow.

19. A fan assembly comprising a system for creating a primary air flow and an annular nozzle comprising:

an outer wall and an inner wall surrounded by the outer wall, the inner wall defining a bore having a bore axis and having a cross-sectional profile in a plane containing the bore axis which is in a shape of part of a surface of an airfoil, wherein the airfoil has a leading edge, a trailing edge, and a chord line extending between the leading edge and the trailing edge, wherein the chord line extends in a direction from the leading edge to the trailing edge towards the bore axis;

an air outlet located at or towards the trailing edge of the airfoil for emitting the air flow; and an interior passage located between the inner and outer walls, and extending about the bore axis for receiving the air flow, wherein the interior passage comprises an air channel that extends towards the air outlet in a direction extending away from the chord line such that the air flow emitted from the air outlet is in the direction extending away from the chord line and the bore axis, the extending direction of the chord line, and the extending direction of the air channel are nonparallel.

* * * * *